US009052693B2

(12) United States Patent
Kawauchiya et al.

(10) Patent No.: US 9,052,693 B2
(45) Date of Patent: Jun. 9, 2015

(54) CONSTANT FORCE DEVICE, MOVEMENT AND MECHANICAL TIMEPIECE

(71) Applicant: SEIKO INSTRUMENTS INC., Chiba-shi, Chiba (JP)

(72) Inventors: Takuma Kawauchiya, Chiba (JP); Takashi Niwa, Chiba (JP); Masahiro Nakajima, Chiba (JP); Masayuki Koda, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/471,241

(22) Filed: Aug. 28, 2014

(65) Prior Publication Data

US 2015/0063084 A1 Mar. 5, 2015

(30) Foreign Application Priority Data

Sep. 4, 2013 (JP) ..... 2013-183351
Jul. 1, 2014 (JP) ..... 2014-136182

(51) Int. Cl.

| | |
|---|---|
| ***G04B 1/22*** | (2006.01) |
| ***G04B 15/10*** | (2006.01) |
| ***G04B 17/22*** | (2006.01) |
| ***G04B 15/14*** | (2006.01) |
| ***G04B 15/12*** | (2006.01) |
| ***G04B 17/28*** | (2006.01) |

(52) U.S. Cl.

CPC ..... *G04B 15/10* (2013.01); *G04B 15/14* (2013.01); *G04B 15/12* (2013.01); *G04B 17/285* (2013.01); *G04B 1/225* (2013.01)

(58) Field of Classification Search

CPC ..... G04B 1/225; G04B 15/10; G04B 17/06; G04B 17/285

USPC ..... 368/124, 127, 130, 147

See application file for complete search history.

(56) References Cited

U.S. PATENT DOCUMENTS

| | | | | |
|---|---|---|---|---|
| 6,997,602 | B2 * | 2/2006 | Mojon et al. | 368/127 |
| 7,473,027 | B2 * | 1/2009 | Goeller | 368/124 |
| 8,038,340 | B2 * | 10/2011 | Schneider | 368/124 |
| 8,550,700 | B2 * | 10/2013 | Wiederrecht | 368/186 |
| 2003/0112709 | A1 | 6/2003 | Mojon | 368/127 |
| 2007/0147179 | A1 * | 6/2007 | Girardin et al. | 368/147 |
| 2012/0250468 | A1 * | 10/2012 | Bas et al. | 368/129 |

* cited by examiner

*Primary Examiner* — Vit W Miska
(74) *Attorney, Agent, or Firm* — Adams & Wilks

(57) ABSTRACT

There are provided a constant force device, a movement, and a mechanical timepiece which can decrease a loss of power for controlling rotation of a stop wheel & pinion. A constant force device includes an inner carriage that outputs an output torque by being rotated around a tenon of a first inner rotation body and a tenon of a second inner rotation body, a constant force spring that supplies a rotation force to the inner carriage, an outer carriage that stores a resilient force in the constant force spring by being rotated around a tenon of a first outer rotation body and a tenon of a second outer rotation body, a stop wheel & pinion that is supported to be rotatable around a stop wheel axle body in the outer carriage, and that is rotatable around the tenon of the first outer rotation body and the tenon of the second outer rotation body, and a stopper that is rotated around the tenon of the first inner rotation body and the tenon of the second inner rotation body together with the inner carriage, and that engages with the stop wheel & pinion in response to rotation of the stop wheel & pinion which is rotated around the stop wheel axle body.

20 Claims, 22 Drawing Sheets

30
34
111
116
115
119
Y4
Y5
67
68
69
99
96
98
3
Y3
6°
3°
76b (76)
76c (76)
76
71
71c
33
70
Y2
31
31d
Y6
Y7
76 (76A)
76 (76B)

CONSTANT FORCE DEVICE, MOVEMENT AND MECHANICAL TIMEPIECE

BACKGROUND OF THE INVENTION

1. Field of the Invention

This invention relates to a constant force device, a movement and a mechanical timepiece.

2. Description of the Related Art

In a mechanical timepiece, if a rotation torque transmitted to an escape wheel & pinion of an escapement from a barrel drum varies in response to unwinding of a main spring in the barrel drum, an oscillation angle of a balance with hairspring is changed and a rate of a timepiece is changed. Therefore, in order to suppress the variation in the rotation torque transmitted to the escape wheel & pinion, a constant force device is proposed in which a constant force spring (pre-tensioning spiral spring) is arranged between the barrel drum and the escapement.

For example, as the constant force device, those which include a stop wheel & pinion having a stop pinion (stop wheel pinion), an escape wheel & pinion having an escape pinion (escape wheel shaft), a tensioning ring attached to a tensioning ring pinion, a constant force spring disposed between the tensioning ring and the escape wheel & pinion, and a cam attached to the escape pinion are proposed. The constant force spring supplies a rotation force to the escape wheel & pinion so that the escape wheel & pinion is rotated with respect to the tensioning ring (for example, refer to Japanese Patent No. 4105941 (Patent Reference 1)).

According to this configuration, whereas rotation of the escape wheel & pinion is stopped or resumed by a pallet of a first anchor, rotation of the stop wheel & pinion is stopped or resumed by a pallet of a second anchor. The second anchor is caused to perform an oscillating movement by a fork-shaped portion engaging with the cam. Then, if the rotation of the stop wheel & pinion is resumed, the tensioning ring is rotated. In this manner, the constant force spring is wound up on a regular basis. Accordingly, it is possible to suppress the variation in the rotation torque transmitted to the escape wheel & pinion.

Incidentally, in the above-described related art, the rotation of the stop wheel & pinion is stopped or resumed by causing the second anchor to perform the oscillating movement using the cam and the fork-shaped portion. Consequently, there is a problem of an increasing loss of power for stopping or resuming the rotation of the stop wheel & pinion.

SUMMARY OF THE INVENTION

It is an aspect of the present application to provide a constant force device, a movement, and a mechanical timepiece which can decrease a loss of power for controlling rotation of a stop wheel & pinion.

There is provided a constant force device for adjusting an output torque according to the present application. The constant force device includes an output unit that outputs the output torque by being rotated around an output axle, a constant force spring that supplies a rotation force to the output unit, an input unit that stores a resilient force in the constant force spring by being rotated around an input axle, a stop wheel & pinion that is supported to be rotatable (revolution on its axis) around a stop wheel axle body in the input unit, and that is rotatable (rotation therearound) around the input axle, and a stopper that is rotated around the output axle together with the output unit, and that engages with the stop wheel & pinion in response to rotation of the stop wheel & pinion which is rotated around the stop wheel axle body.

In this manner, it is possible to stop or resume the rotation of the stop wheel & pinion, and to adjust a rotation progress degree thereof by rotating the stopper around the output axle. Therefore, a movement of the stopper disengaged from the stop wheel & pinion functions as the rotation movement similar to the stop wheel & pinion, thereby enabling a loss of power to be decreased. In other words, since a transmission route is simplified between the stop wheel & pinion and the output unit, it is possible to decrease the loss received by the output unit from the stop wheel & pinion. Accordingly, it is possible to more stably ensure the output torque of the output unit.

In the constant force device according to the present application, the input axle and the output axle are arranged coaxially with each other.

According to this configuration, since a transmission distance is effectively shortened between the stop wheel & pinion and the output unit, it is possible to further suppress the loss.

The constant force device according to the present application further includes a fixed wheel & pinion that is disposed coaxially with the input axle, and that is not rotatable together with the input unit and the output unit, in other words, a fixed wheel & pinion that is arranged so as to be separated from the rotation movement of the input unit and the output unit by itself. The stop wheel & pinion has a stop wheel axle body in which the stop wheel axle serves as an axial center, and the stop wheel axle body is configured to be rotatable around the input axle by being arranged so as to engage with the fixed wheel & pinion.

According to this configuration, the stop wheel & pinion can perform a planetary movement for the revolution and the rotation while meshing with the fixed wheel & pinion. Accordingly, the stop wheel & pinion can perform the revolution and the rotation by being rotated around the input axle of the input unit to which the stop wheel & pinion is rotatably attached. Accordingly, it becomes possible to adjust the rotation progress degree of the stop wheel & pinion by using a simple structure. Therefore, it is possible to effectively utilize a space around the input unit and the stop wheel & pinion. Then, in conjunction with an efficient space arrangement for the above-described stopper, the constant force device can be efficiently laid out.

In the constant force device according to the present application, the stop wheel & pinion has a tooth surface formed in a substantially arc shape in which the input axle serves as a center.

As described above, the stop wheel & pinion has the arc-shaped tooth surface in view of a frictional angle, that is, the tooth surface formed in the substantially arc shape, in which the input axle serves as the center. Accordingly, the tooth surface of teeth of the stop wheel & pinion is formed in accordance with a movement locus of the stopper. Therefore, when the stop wheel & pinion and the stopper are engaged with each other, a friction loss caused by sliding between both of these is suppressed, and it is possible to prevent the stopper from receiving an unnecessary load. Accordingly, it is possible to suppress the loss received by the output unit from the stop wheel & pinion, thereby enabling a stable output.

In the constant force device according to the present application, the output unit supports a balance with hairspring so as to be rotatable.

According to this configuration, it is possible to rotate the balance with hairspring together with the output unit. Therefore, it is possible to reduce influence of gravity which is caused by an orientation of the balance with hairspring. That is, this configuration can function as a tourbillion mechanism which can suppress a change in oscillation cycles of the balance with hairspring which is caused by a direction of the gravity.

In the constant force device according to the present application, the output unit is configured to any one from among an escape wheel & pinion, a second wheel & pinion, a third wheel & pinion, and a center wheel & pinion.

According to this configuration, it is possible to save the arrangement space of the constant force device. A component configuring the constant force device can be shared with a component configuring an escapement or a train wheel. Therefore, it is possible to reduce the number of components in the constant force device.

The constant force device according to the present application further includes a phase shift regulation mechanism that regulates a rotation movement of the output unit with respect to the input unit. The phase shift regulation mechanism at least regulates the rotation movement in a direction in which a phase of the input unit is delayed with respect to the output unit.

According to this configuration, it is possible to prevent the phase of the input unit from being delayed with respect to the output unit. Therefore, for example, when a second hand or the like is disposed in the input unit, it is possible to prevent seriously misaligned display of the second hand.

In addition, it is possible to regulate the maximum separated distance between the stop wheel & pinion and the stopper. Therefore, for example, even when a sudden input torque is applied to the input unit and the stop wheel & pinion suddenly collides with the stopper, it is possible to weaken a collision force. Accordingly, it is possible to prevent damage to the stopper or the stop wheel & pinion.

In the constant force device according to the present application, the phase shift regulation mechanism regulates the rotation movement in a direction in which a phase of the input unit is quickened with respect to the output unit.

According to this configuration, when the output unit is reversely rotated due to a drop impact or the like, it is possible to prevent the stop wheel & pinion and the stopper from being damaged due to the collision of the stopper with the stop wheel & pinion.

In the constant force device according to the present application, the phase shift regulation mechanism has a projection which is formed in any one of the output unit and the input unit, and a hole which is formed in the other one of the output unit and the input unit, and which can engage with the projection.

According to this configuration, it is possible to allow the phase shift regulation mechanism to have a simple structure.

A movement according to the present application includes the constant force device and a balance with hairspring that is operated by an output torque supplied from the constant device.

According to this configuration, it is possible to provide the movement which can decrease the loss of the power for controlling the rotation of the stop wheel & pinion.

A mechanical timepiece according to the present application includes the movement.

According to this configuration, it is possible to provide the mechanical timepiece which can decrease the loss of the power for controlling the rotation of the stop wheel & pinion.

According to the present application, it is possible to stop or resume the rotation of the stop wheel & pinion, and to adjust the rotation progress degree thereof by rotating the stopper around the output axle. Therefore, the movement of the stopper disengaged from the stop wheel & pinion functions as the rotation movement similar to the stop wheel & pinion, thereby enabling the loss of the power to be decreased. In other words, since the transmission route is simplified between the stop wheel & pinion and the output unit, it is possible to decrease the loss received by the output unit from the stop wheel & pinion. Accordingly, it is possible to more stably ensure the output torque of the output unit.

DETAILED DESCRIPTION OF THE PREFERRED EMBODIMENTS

First Embodiment

Mechanical Timepiece

Next, a first embodiment of this invention will be described with reference to FIGS. 1 to 11.

Figure 1:
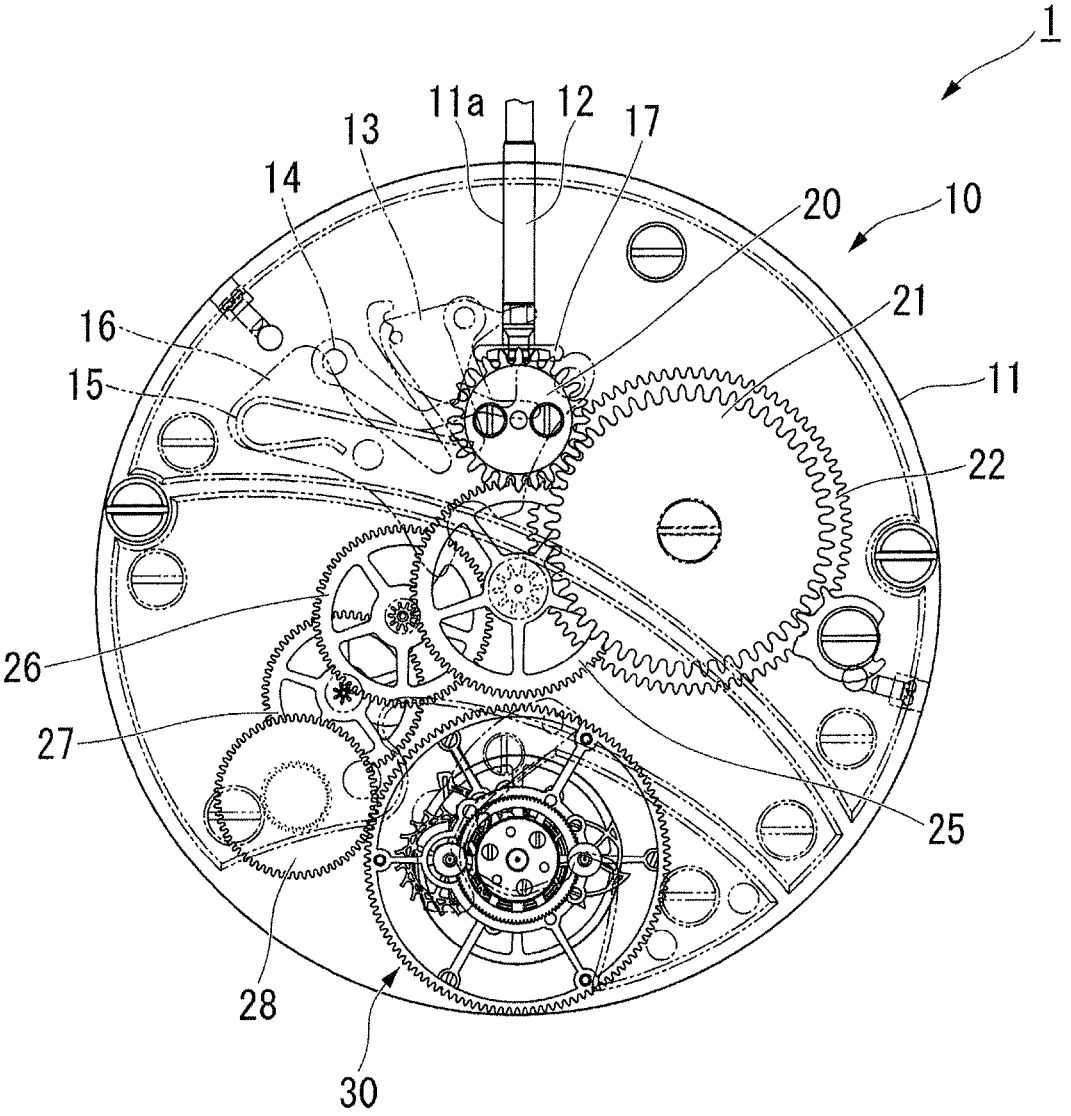
FIG. 1 is a plan view of a front side of a movement of a mechanical timepiece according to a first embodiment of the present invention.

FIG. 1 is a plan view of a front side of a movement of a mechanical timepiece 1.

As illustrated in the drawing, the mechanical timepiece is configured to have a movement 10 and a case (not illustrated) for accommodating the movement 10.

The movement 10 has a main plate 11 configuring a substrate. A dial (not illustrated) is arranged in a rear side of the main plate 11. A train wheel incorporated in a front side of the movement 10 is referred to as a front train wheel, and a train wheel incorporated in a rear side of the movement 10 is referred to as a rear train wheel.

A winding stem guide hole 11*a* is formed in the main plate 11 and a winding stem 12 is rotatably incorporated therein. The winding stem 12 has an axially determined position by a switching device having a setting lever 13, a yoke 14, a yoke spring 15, and a setting lever jumper 16. In addition, a winding pinion 17 is rotatably disposed in a guide axle of the winding stem 12.

In such a configuration, if the winding stem 12 is rotated in a state where the winding stem 12 is located in a first winding stem position (zero stage) closest to an inner side of the movement 10 along an axle direction, the winding pinion 17 is rotated via the rotation of a clutch wheel (not illustrated). Then, if the winding pinion 17 is rotated, a crown wheel 20 meshing therewith is rotated. Then, if the crown wheel 20 is rotated, a ratchet wheel 21 meshing therewith is rotated. Furthermore, if the ratchet wheel 21 is rotated, a main spring (not illustrated) accommodated in a barrel wheel 22 is wound up.

The front train wheel of the movement 10 is configured to include not only the barrel wheel 22 but also a center wheel & pinion 25, a third wheel & pinion 26 and a second wheel & pinion 27, and a fifth wheel & pinion 28, and fulfills a function of transmitting a rotation force of the barrel wheel 22. In addition, a tourbillion with constant force device 30 which controls the rotation of front train wheel is arranged on the front side of the movement 10.

The center wheel & pinion 25 meshes with the barrel wheel 22. The third wheel & pinion 26 meshes with the center wheel & pinion 25. The second wheel & pinion 27 meshes with the third wheel & pinion 26. The fifth wheel & pinion 28 meshes with the second wheel & pinion 27. Then, the tourbillion with constant force device 30 meshes with the fifth wheel & pinion 28.

(Tourbillion with Constant Force Device)

Figure 2:
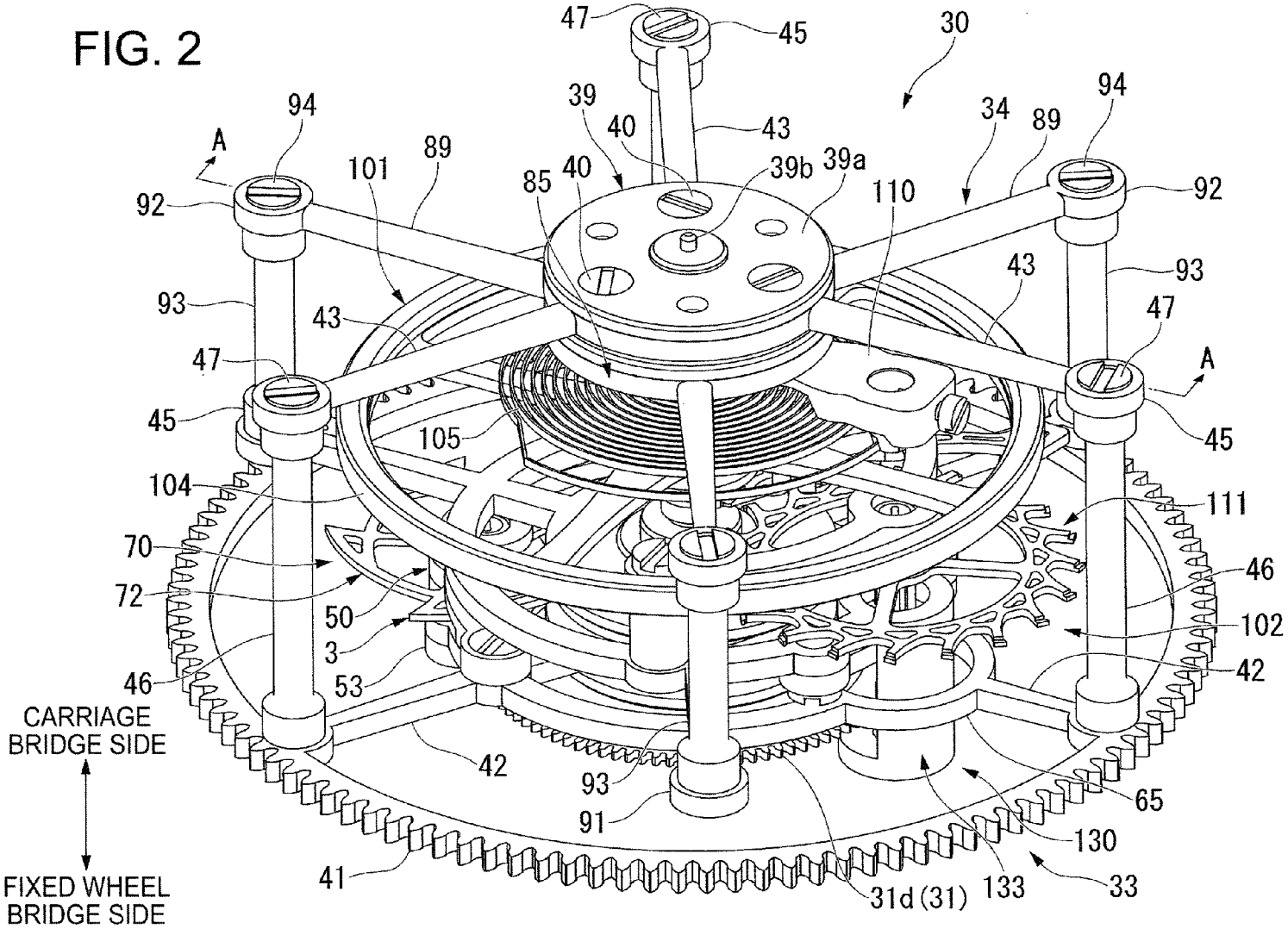
FIG. 2 is a perspective view of a tourbillion with constant force device according to the first embodiment of the present invention.
Figure 3:
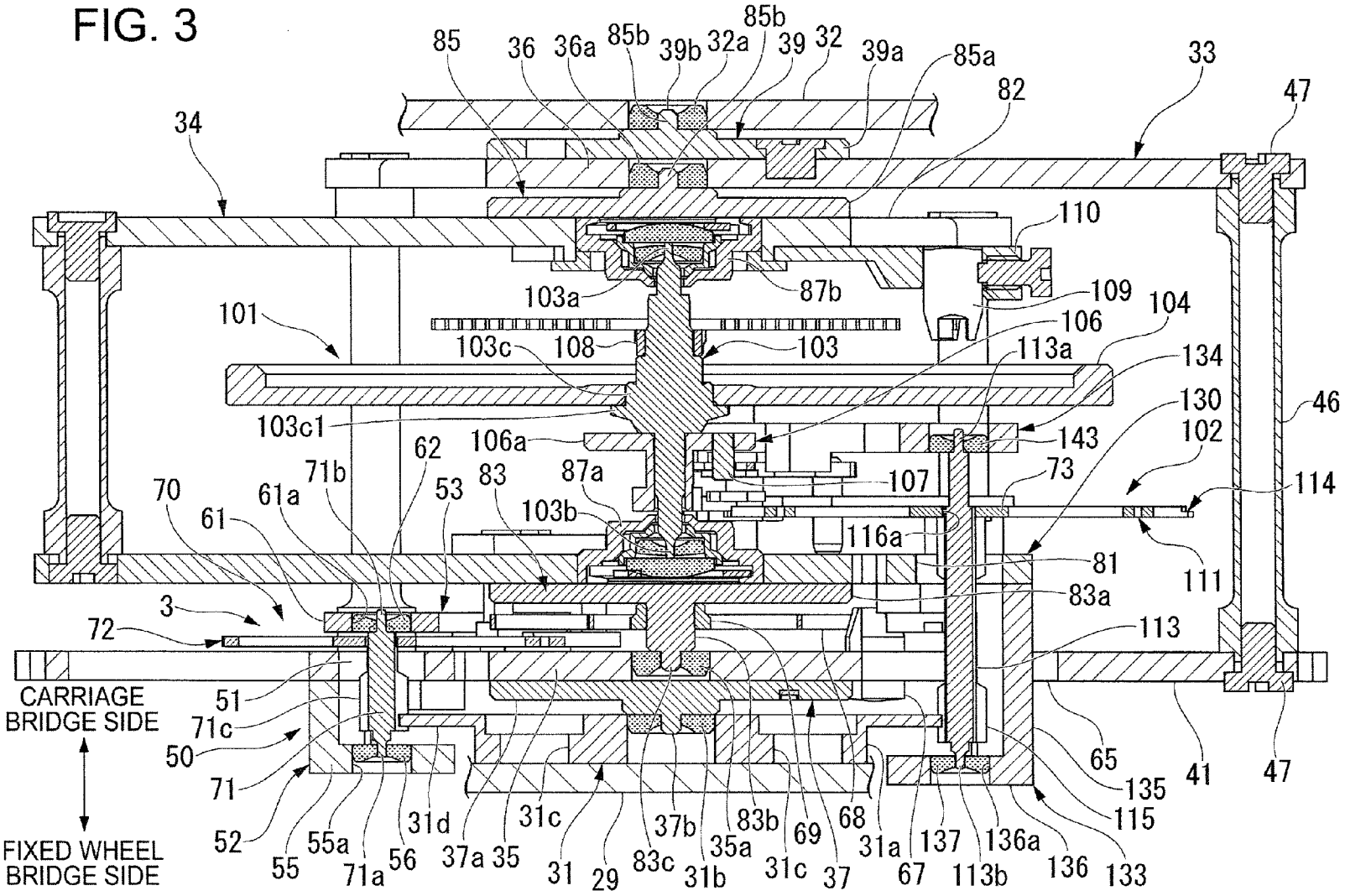
FIG. 3 is a cross-sectional view taken along line A-A in FIG. 2.

FIG. 2 is a perspective view of the tourbillion with constant force device 30, and FIG. 3 is a cross-sectional view taken along line A-A in FIG. 2.

As illustrated in FIGS. 2 and 3, the tourbillion with constant force device 30 is a mechanism for controlling the rotation of the above-described front train wheel. In addition, the tourbillion with constant force device 30 has a so-called tourbillion mechanism which reduces influence of gravity which is caused by an orientation of a balance with hairspring 101 (to be described later) and suppresses a disordered operation of the balance with hairspring 101. In addition, the tourbillion with constant force device 30 includes a constant force device 3 for suppressing variations in a rotation torque transmitted to an escape wheel & pinion 111 (to be described later).

Hereinafter, the tourbillion with constant force device 30 will be described in detail.

The tourbillion with constant force device 30 includes a fixed wheel & pinion 31 which is fixed to the main plate 11 side in a fixed wheel bridge 29 attached to the front side of the main plate 11, an outer carriage (input unit) 33 which is attached to the rear side of the main plate 11 and is rotatably supported between the fixed wheel bridge 29 (refer to FIG. 3) and a carriage bridge 32 arranged to oppose the fixed wheel bridge 29, and an inner carriage (output unit) 34 which is supported inside the outer carriage 33 so as to be rotatable with respect to the outer carriage 33.

The fixed wheel & pinion 31 has a wheel main body 31*a* having a substantially disk shape. A hole jewel 31*b* for rotatably supporting the outer carriage 33 is disposed in a substantial center of the wheel main body 31*a* in a radial direction. In addition, a screw insertion hole 31*c* for fastening and fixing the fixed wheel & pinion 31 to the fixed wheel bridge 29 is formed in a periphery of the hole jewel 31*b* of the wheel main body 31*a*. A screw (not illustrated) is inserted into the screw insertion hole 31*c*. Furthermore, a tooth portion 31*d* is formed in an outer peripheral portion of the wheel main body 31*a*.

(Outer Carriage)

Figure 4:
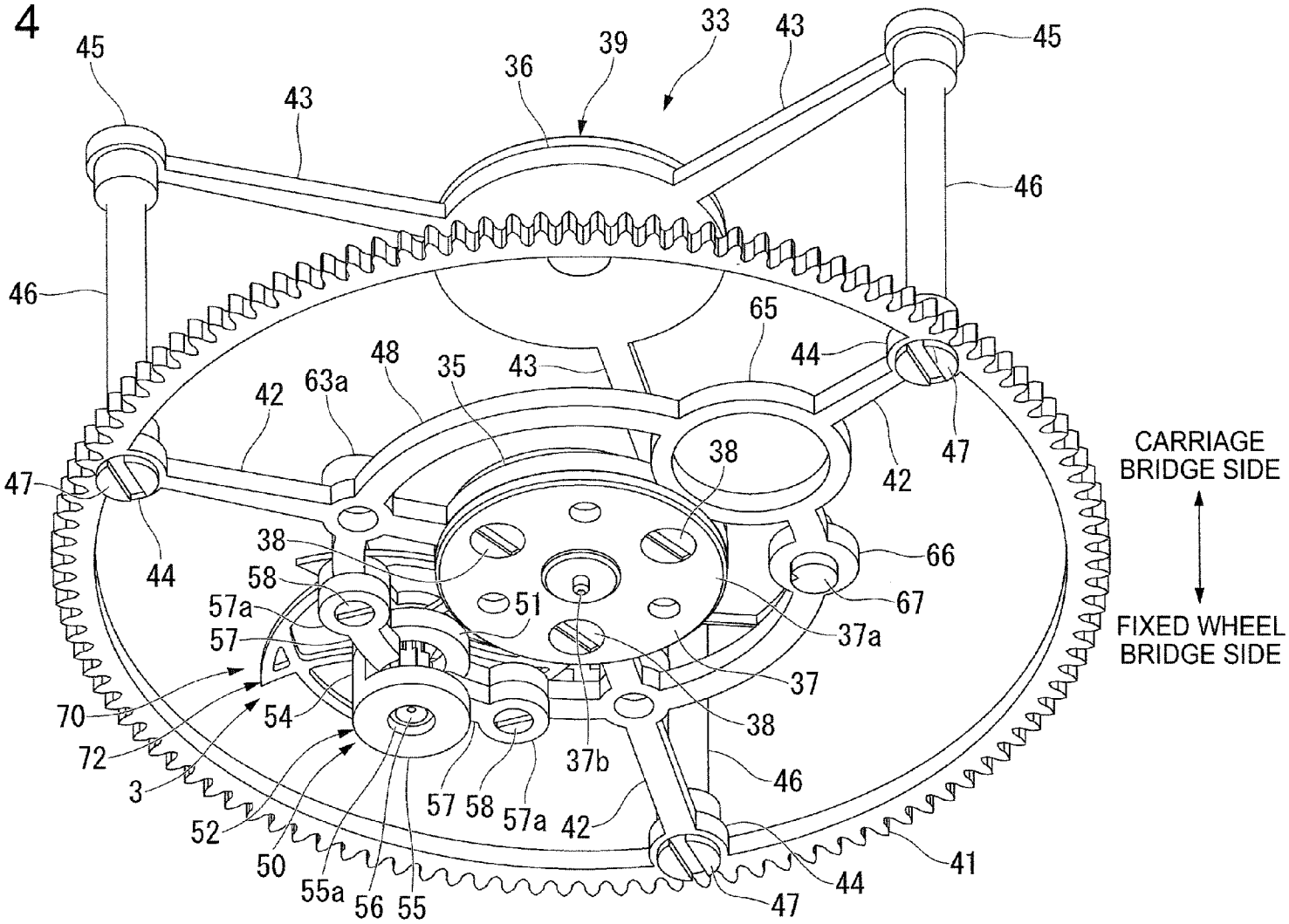
FIG. 4 is a perspective view when an outer carriage according to the first embodiment of the present invention is viewed from a fixed wheel bridge side.
Figure 5:
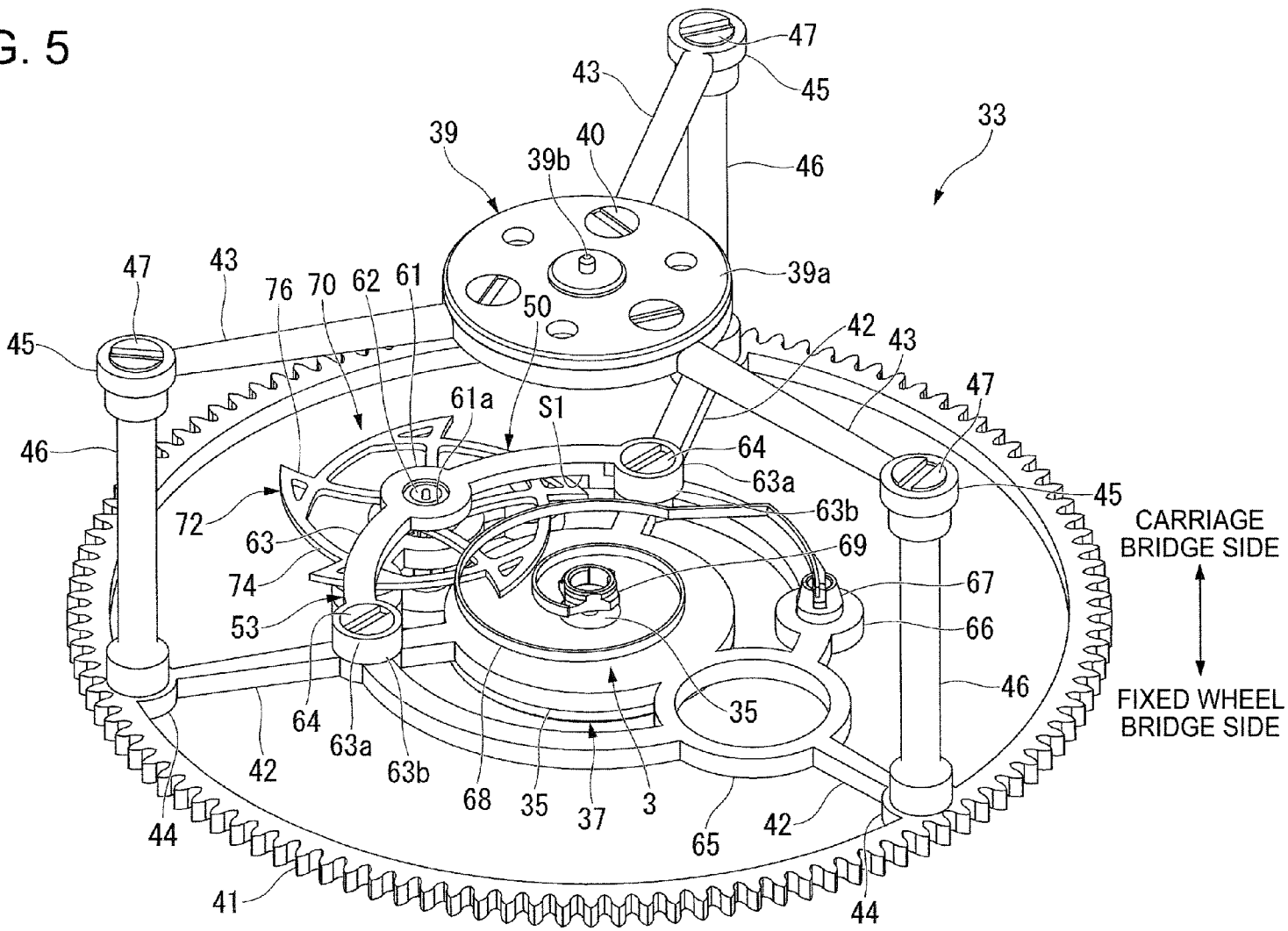
FIG. 5 is a perspective view when the outer carriage according to the first embodiment of the present invention is viewed from a carriage bridge side.

FIG. 4 is a perspective view when the outer carriage 33 is viewed from the fixed wheel bridge 29 side, and FIG. 5 is a perspective view when the outer carriage 33 is viewed from the carriage bridge 32 side.

As illustrated in FIGS. 2 to 5, the outer carriage 33 has a substantially disk-shaped first outer carriage bearing 35 which is arranged on the fixed wheel bridge 29 side, and a substantially disk-shaped second outer carriage bearing 36 which is arranged on the carriage bridge 32 side. The first outer carriage bearing 35 and the second outer carriage bearing 36 are arranged coaxially with the fixed wheel & pinion 31.

In addition, a hole jewel 35*a* is disposed coaxially with the hole jewel 31*b* of the fixed wheel & pinion 31 in the first outer carriage bearing 35. The hole jewel 35*a* is used for rotatably supporting an inner carriage 34. Furthermore, a first outer rotation body 37 is disposed on a surface on the fixed wheel bridge 29 side of the first outer carriage bearing 35.

In order to correspond to a shape of the first outer carriage bearing 35, the first outer rotation body 37 is configured to integrally mold a base 37*a* formed in a substantially disk shape and a tenon 37*b* protruding toward the fixed wheel bridge 29 side from a substantial center of the base 37*a* in the radial direction. The base 37*a* is fastened and fixed to the first outer carriage bearing 35 by a screw 38. In addition, the tenon 37*b* is inserted into the hole jewel 31*b* of the fixed wheel & pinion 31. In this manner, the first outer rotation body 37 is rotatably supported by the fixed wheel & pinion 31.

In contrast, a hole jewel 36*a* is disposed coaxially with the hole jewel 35*a* of the first outer carriage bearing 35, in the second outer carriage bearing 36. The hole jewel 36*a* is also used for rotatably supporting the inner carriage 34 in cooperation with the hole jewel 35*a* of the first outer carriage bearing 35. In addition, a second outer rotation body 39 is disposed on a surface on the carriage bridge 32 side of the second outer carriage bearing 36.

In order to correspond to a shape of the second outer carriage bearing 36, the second outer rotation body 39 is configured to integrally mold a base 39*a* formed in a substantially disk shape and a tenon 39*b* protruding toward the carriage bridge 32 side from a substantial center of the base 39*a* in the radial direction. The tenon 39*b* is rotatably supported by a hole jewel 32*a* of the carriage bridge 32. In addition, the base 39*a* is fastened and fixed to the second outer carriage bearing 36 by a screw 40.

Furthermore, a ring-shaped external gear 41 is disposed on a further radially outer side from the first outer carriage bearing 35. The external gear 41 meshes with the fifth wheel & pinion 28.

In addition, the external gear 41 and the first outer carriage bearing 35 are connected to each other by three first arms 42. The three first arms 42 extend along the radial direction, and are arranged at equal intervals in a circumferential direction.

In contrast, three second arms 43 extending radially outward are integrally molded in the outer peripheral portion of the second outer carriage bearing 36. These second arms 43 are arranged at equal intervals in the circumferential direction so as to correspond to the first arms 42 on the first outer carriage bearing 35 side.

Substantially disk-shaped shaft washers 44 and 45 are respectively and integrally molded in a connection portion between the first arm 42 and the external gear 41 and a distal end of the second arm 43. Then, shafts 46 extending along the axial direction are respectively disposed between the shaft washers 44 and 45. Both ends of the shaft 46 are fastened and fixed to the shaft washers 44 and 45 by a screw 47 which is screwed from above the shaft washers 44 and 45.

In addition, a support bar 48 formed in a ring shape so as to surround the periphery of the first outer carriage bearing 35 is disposed between the first outer carriage bearing 35 and the external gear 41. The inner diameter of the support bar 48 is set to be substantially the same as the outer diameter of the tooth portion 31*d* of the fixed wheel & pinion 31.

In addition, the support bar 48 is integrally molded so as to be connected to the first arm 42. A stop wheel bearing unit 50 and a stop wheel & pinion 70 rotatably supported by the stop wheel bearing unit 50 are disposed in the support bar 48.

Here, the stop wheel bearing unit 50 and the stop wheel & pinion 70 configure the constant force device 3. The constant force device 3 has a constant force spring 68 (to be described later) and a stopper 96 in addition to the stop wheel bearing unit 50 and the stop wheel & pinion 70.

The stop wheel bearing unit 50 is configured to have a ring-shaped axle body insertion portion 51 which is integrally molded on the support bar 48, a first stop wheel bearing 52 which is attached to the fixed wheel bridge 29 side of the support bar 48, and a second stop wheel bearing 53 which is attached to the carriage bridge 32 side of the support bar 48.

The first stop wheel bearing 52 has a wall 54 extending toward the fixed wheel bridge 29 side from a position corresponding to the axle body insertion portion 51 of the support bar 48. The wall 54 is formed in a substantially cross-sectional C-shape so as to open a radially inner side. A substantially disk-shaped bearing washer 55 is integrally molded on an inner peripheral surface of the distal end of the wall 54 so as to be orthogonal to the wall 54. Then, a through-hole 55*a* penetrating in the thickness direction is formed in the substantial center of the bearing washer 55 in the radial direction. A hole jewel 56 for rotatably support the stop wheel & pinion 70 is disposed in the through-hole 55*a*.

In addition, a pair of mounting stays 57 extending to both sides across the wall 54 is integrally molded on a proximal end side of the wall 54. Substantially disk-shaped screw washers 57*a* are respectively and integrally molded in the distal end of the pair of mounting stays 57. The screw washer 57*a* is fastened and fixed to the support bar 48 by a screw 58.

In contrast, the second stop wheel bearing 53 has a substantially disk-shaped bearing washer 61 which is arranged at a position corresponding to the axle body insertion portion 51 formed in the support bar 48. Then, a through-hole 61*a* penetrating in the thickness direction is formed in the substantial center of the bearing washer 61 in the radial direction. A hole jewel 62 for rotatably supporting the stop wheel & pinion 70 is disposed in the through-hole 61*a*.

A pair of mounting stays 63 is integrally molded on both sides in the outer peripheral portion of the bearing washer 61 across the hole jewel 62. Substantially disk-shaped screw washers 63*a* are respectively and integrally molded in the distal end of the pair of mounting stays 63. The screw washer 63*a* is fastened and fixed to the support bar 48 by a screw 64.

Rising portions 63*b* are respectively formed in the distal end portion of the screw washer 63*a* and the mounting stay 63. A gap S1 is formed between the bearing washer 61, the mounting stay 63, and the support bar 48. A stop wheel 72 configuring the stop wheel & pinion 70 is interposed in the gap S1.

In addition to the stop wheel 72, the stop wheel & pinion 70 has a stop wheel axle body 71 inserted into the axle body insertion portion 51 formed in the support bar 48. Tenons 71*a* and 71*b* are respectively and integrally molded in both ends of the stop wheel axle body 71. The tenon 71*a* on the fixed wheel bridge 29 side is rotatably supported by the hole jewel 56 of the first stop wheel bearing 52. In contrast, the tenon 71*b* on the carriage bridge 32 side is rotatably supported by the hole jewel 62 of the second stop wheel bearing 53.

In addition, a stop pinion 71*c* is integrally molded in the stop wheel axle body 71, from the substantial center in the axial direction through the front of the tenon 71*a* on the fixed wheel bridge 29 side. Here, the inner diameter of the support bar 48 in which the stop wheel bearing unit 50 is disposed is set to be substantially the same as the outer diameter of the tooth portion 31*d* of the fixed wheel & pinion 31. Accordingly, the stop pinion 71*c* is adapted to mesh with the tooth portion 31*d*. In contrast, the stop wheel 72 is externally fitted and fixed to the vicinity of a base portion of the tenon 71*b* on the carriage bridge 32 side in the stop wheel axle body 71. The stop wheel axle body 71 and the stop wheel 72 are integrated with each other so as not to be relatively rotatable.

Figure 6:
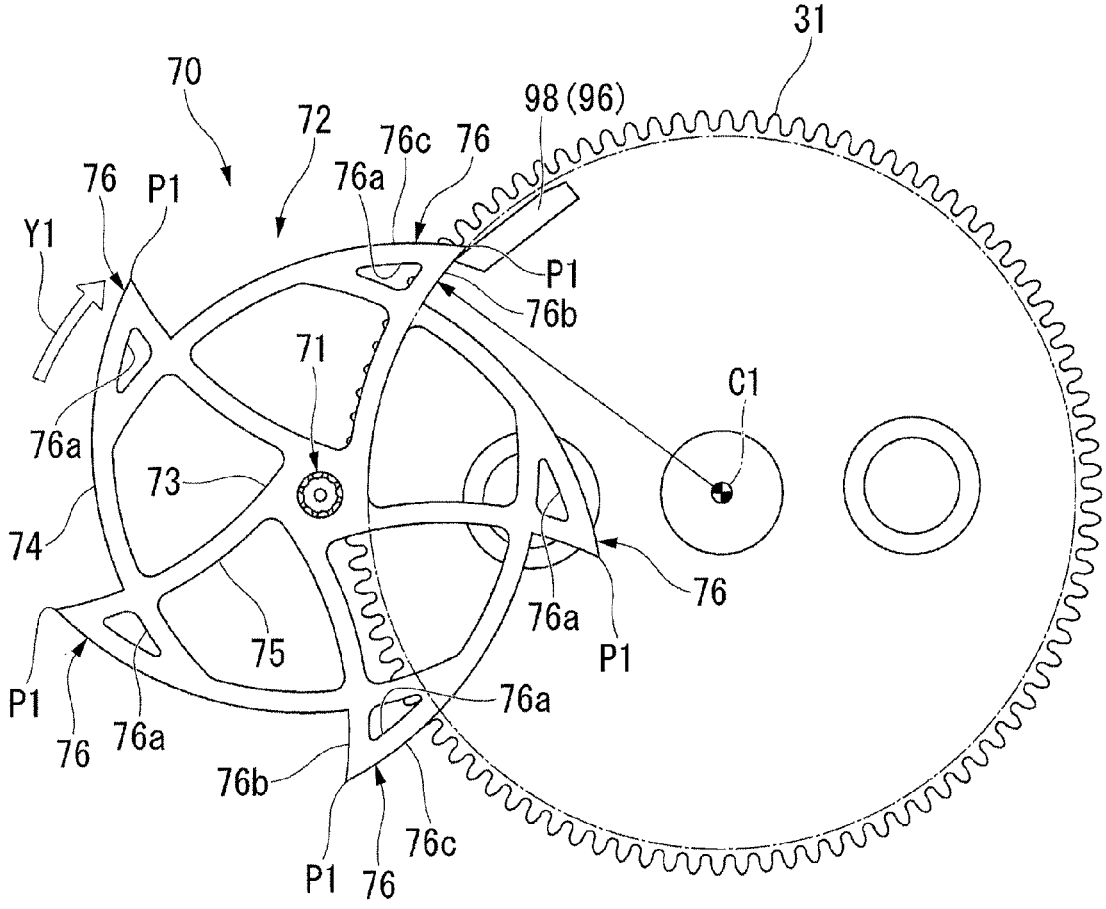
FIG. 6 is a plan view of a stop wheel according to the first embodiment of the present invention.

FIG. 6 is a plan view of the stop wheel 72.

As illustrated in the drawing, for example, the stop wheel 72 is formed of a material having a crystal orientation, such as a metal material and single crystal silicon, and is formed by means of a lithographie galvanoformung abformung (LIGA) process in which an optical method such as electroforming and a photolithography technology is incorporated, deep reactive ion etching (DRIE), or metal injection molding (MIM).

The stop wheel 72 is formed by integrally molding a central hub 73 which is externally fitted and fixed to the stop wheel axle body 71, a rim 74 which is arranged outside in the radial direction of the hub 73 and is formed in a ring shape so as to surround the periphery of the hub 73, and a spoke 75 which connects the hub 73 and the rim 74.

Multiple (five in this embodiment) hooks 76 are formed to protrude radially outward in the outer peripheral portion of the rim 74. More specifically, the hook 76 is formed in a substantially triangular shape in a plan view in the axial direction, and a substantially triangular opening 76*a* is formed in a most central portion thereof. In addition, the hook 76 is formed so that an apex P1 thereof is oriented in a rotation direction (clockwise direction in FIG. 6) Y1 of the stop wheel 72. A lateral side 76*b* on the front side in the rotation direction Y1 is set to be shorter than a lateral side 76*c* on the rear side in the rotation direction Y1. In other words, whereas the lateral side 76*b* on the front side is formed to be connected to the spoke 75, the lateral side 76*c* on the rear side is formed to be connected to the rim 74. Details of a rotation operation of the stop wheel 72 will be described later.

Here, the spoke 75 and the lateral side 76*b* on the front side are formed in an arc shape. Then, the center of the arc is located coaxially with an axial center C1 of the fixed wheel & pinion 31, that is, the rotation center of the outer carriage 33.

According to this configuration, the stopper 96 (to be described later) disposed in the inner carriage 34 is engaged with or disengaged from the lateral side 76*b* on the front side of the hook 76.

In addition, as illustrated in FIGS. 4 and 5, in the support bar 48, a ring-shaped bearing unit insertion portion 65 is integrally molded on a side which is radially opposite to the axle body insertion portion 51 in the first outer carriage bearing 35. A bearing 133 of an escapement mechanism bearing unit 130 (to be described later) is inserted into the bearing unit insertion portion 65. In addition, one among the three first arms 42 protrudes in the outer peripheral portion of the bearing unit insertion portion 65.

Furthermore, a stud support 66 is integrally molded at a position adjacent to the bearing unit insertion portion 65, in the support bar 48. A stud 67 is press-fitted to the stud support 66. An outer end portion of the constant force spring 68 is fixed to the stud support 67.

The constant force spring 68 is to supply a rotation force to the inner carriage 34 with respect to the outer carriage 33, and is formed in a spiral shape. An inner end portion of the constant force spring 68 is fixed to the inner carriage 34 via a collet 69.

(Inner Carriage)

Figure 7:
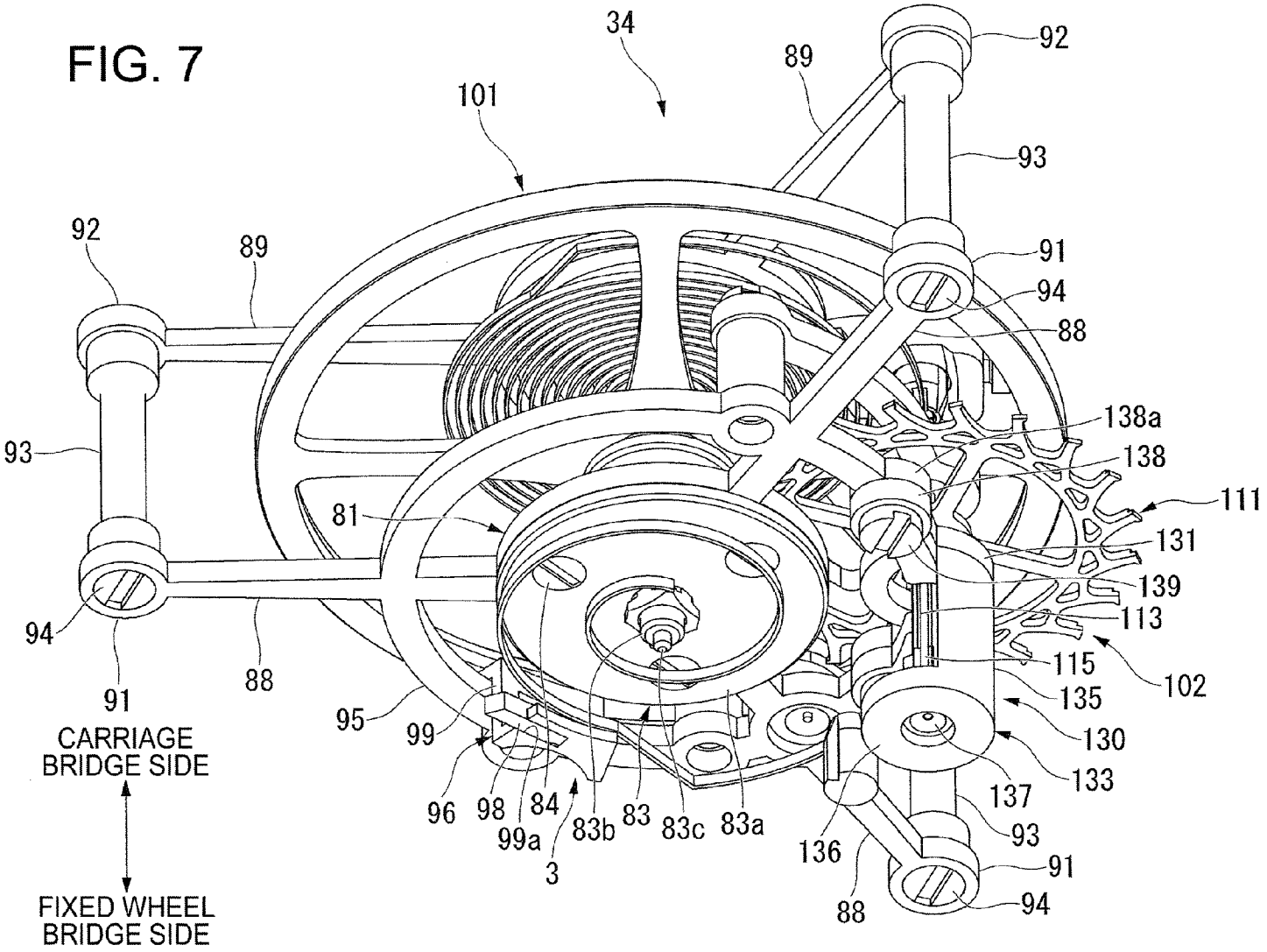
FIG. 7 is a perspective view when an inner carriage according to the first embodiment of the present invention is viewed from the fixed wheel bridge side.
Figure 8:
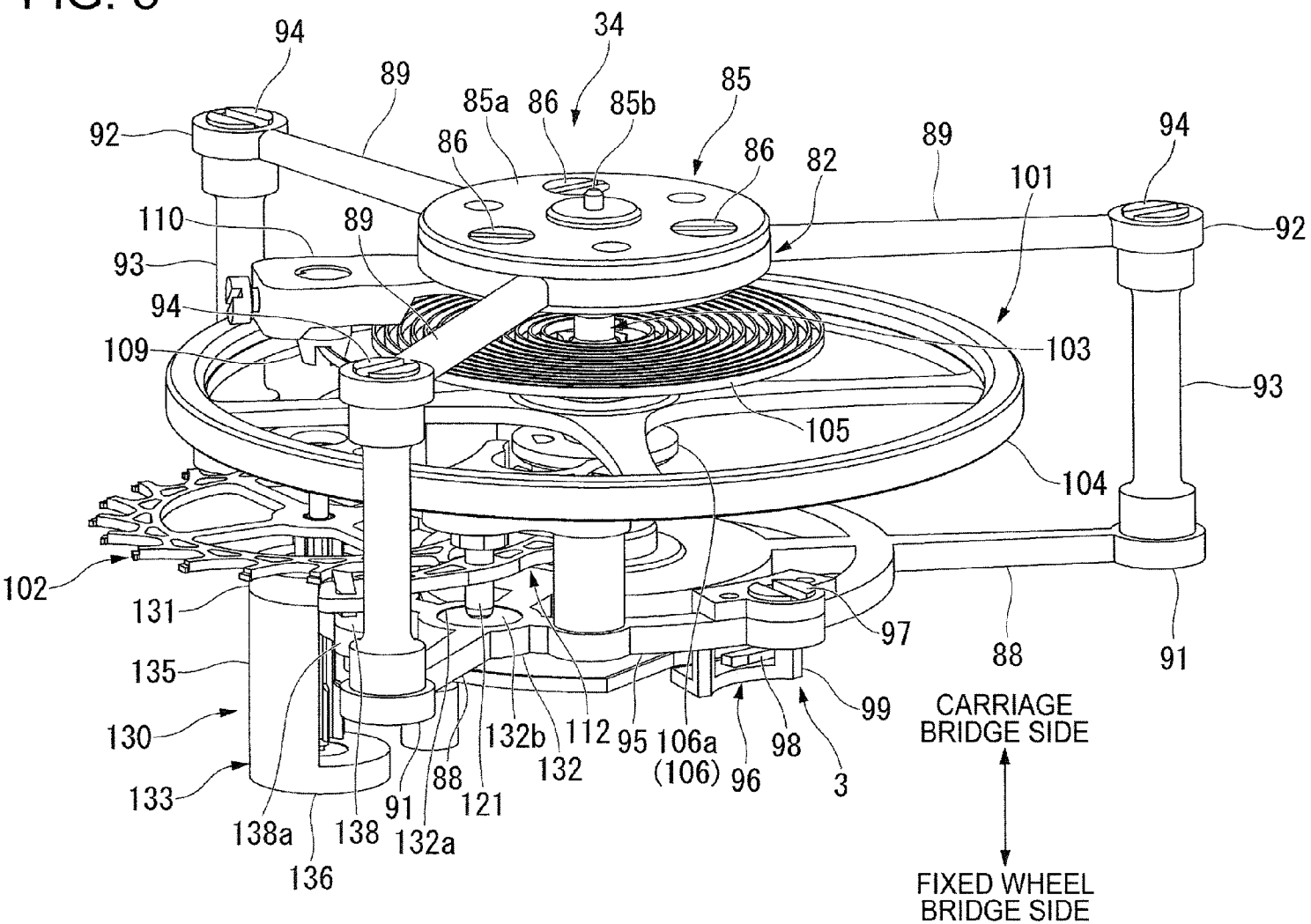
FIG. 8 is a perspective view when the inner carriage according to the first embodiment of the present invention is viewed from the carriage bridge side.

FIG. 7 is a perspective view when the inner carriage 34 is viewed from the fixed wheel bridge 29 side, and FIG. 8 is a perspective view when the inner carriage 34 is viewed from the carriage bridge 32 side.

As illustrated in FIGS. 2, 3, 7, and 8, the inner carriage 34 has a substantially disk-shaped first inner carriage bearing 81 which is arranged on the fixed wheel bridge 29 side, and a substantially disk-shaped second inner carriage bearing 82 which is arranged on the carriage bridge 32 side. The first inner carriage bearing 81 and the second inner carriage bearing 82 are arranged coaxially with the first outer carriage bearing 35 and the second outer carriage bearing 36 of the outer carriage 33.

In addition, a first inner rotation body 83 is disposed on a surface of the first inner carriage bearing 81 on the first outer carriage bearing 35 side. In order to correspond to a shape of the first inner carriage bearing 81, the first inner rotation body 83 is formed by integrally molding a base 83*a* which is formed in a substantially disk shape, an axle 83*b* which protrudes toward the first outer carriage bearing 35 side from the substantial center of the base 83*a* in the radial direction, and a tenon 83*c* which protrudes from the distal end of the axle 83*b*.

Then, the base 83*a* is fastened and fixed to the first inner carriage bearing 81 by a screw 84. In addition, the tenon 83*c* is inserted into the hole jewel 35*a* of the first outer carriage bearing 35. In this manner, the inner carriage 34 is supported to be rotatable with respect to the outer carriage 33.

In addition, the constant force spring 68 and the collet 69 are fixed to the axle 83*b*. In this manner, a biasing force of the constant force spring 68 is applied to the inner carriage 34 with respect to the outer carriage 33. That is, a rotation force is applied to the inner carriage 34 with respect to the outer carriage 33 by the constant force spring 68.

In contrast, a second inner rotation body 85 is disposed on a surface of the second inner carriage bearing 82 on the second outer carriage bearing 36 side. In order to correspond to a shape of the second inner carriage bearing 82, the second inner rotation body 85 is formed by integrally molding a base 85*a* which is formed in a substantially disk shape, and a tenon 85*b* which protrudes toward the second outer carriage bearing 36 side from the substantial center of the base 85*a* in the radial direction. The tenon 85*b* is rotatably supported by the hole jewel 36*a* of the second outer carriage bearing 36. In addition, the base 85*a* is fastened and fixed to the second inner carriage bearing 82 by a screw 86.

Furthermore, seismic bearings 87*a* and 87*b* are respectively disposed in the first inner carriage bearing 81 and the second inner carriage bearing 82. The seismic bearings 87*a* and 87*b* are arranged coaxially with the hole jewel 35*a* of the first outer carriage bearing 35 and the hole jewel 36*a* of the second outer carriage bearing 36. The seismic bearings 87*a* and 87*b* are to rotatably support the balance with hairspring 101 (to be described later).

Three first arms 88 extending radially outward are integrally molded in the outer peripheral portion of the first inner carriage bearing 81. Furthermore, three second arms 89 extending radially outward are integrally molded in the outer peripheral portion of the second inner carriage bearing 82. The first arms 88 and the second arms 89 are respectively arranged at equal intervals in the circumferential direction, and further are arranged so as to oppose each other in the axial direction. In addition, the respective first arms 88 are arranged to be located between the three first arms 42 which are respectively formed in the outer carriage 33. Furthermore, the respective second arms 89 are arranged to be located between the three second arms 43 which are respectively formed in the outer carriage 33.

In addition, substantially disk-shaped shaft washers 91 and 92 are respectively and integrally molded in the distal end of the respective arms 88 and 89. Then, shafts 93 extending along the axial direction are respectively disposed between the shaft washers 91 and 92. Both ends of the shaft 93 are fastened and fixed to the shaft washers 91 and 92 by a screw 94 screwed from above the shaft washers 91 and 92.

Furthermore, a support bar 95 formed in a ring shape so as to surround the periphery of the first inner carriage bearing 81 is disposed outside the first inner carriage bearing 81 in the radial direction. The inner diameter of the support bar 95 is set to be substantially the same as the outer diameter of the tooth portion 31*d* of the fixed wheel & pinion 31. In addition, the support bar 95 is integrally molded so as to be connected to the first arm 88.

The stopper 96 is disposed in the support bar 95. The stopper 96 is engaged with or disengaged from the hook 76 of the stop wheel & pinion 70 in response to the rotation movement of the stop wheel & pinion 70 disposed in the inner carriage 34 or the outer carriage 33 (details to be described later).

The stopper 96 is configured to have a pawl 98 which comes into contact with the hook 76 of the stop wheel & pinion 70, and a support portion 99 which supports the pawl 98. The support portion 99 is formed in a substantially cross-sectional Z-shape, and a slit 99*a* is formed on the fixed wheel bridge 29 side so that the stop wheel & pinion 70 side is open. The pawl 98 is accommodated in and fixed to the slit 99*a*. In addition, a side opposite to the side of the support portion 99 to which the pawl 98 is fixed is fastened and fixed to the support bar 95 by a screw 97.

Furthermore, the escapement mechanism bearing unit 130 is disposed in the support bar 95. The escapement mechanism bearing unit 130 supports an escapement 102 (to be described later).

Figure 9:
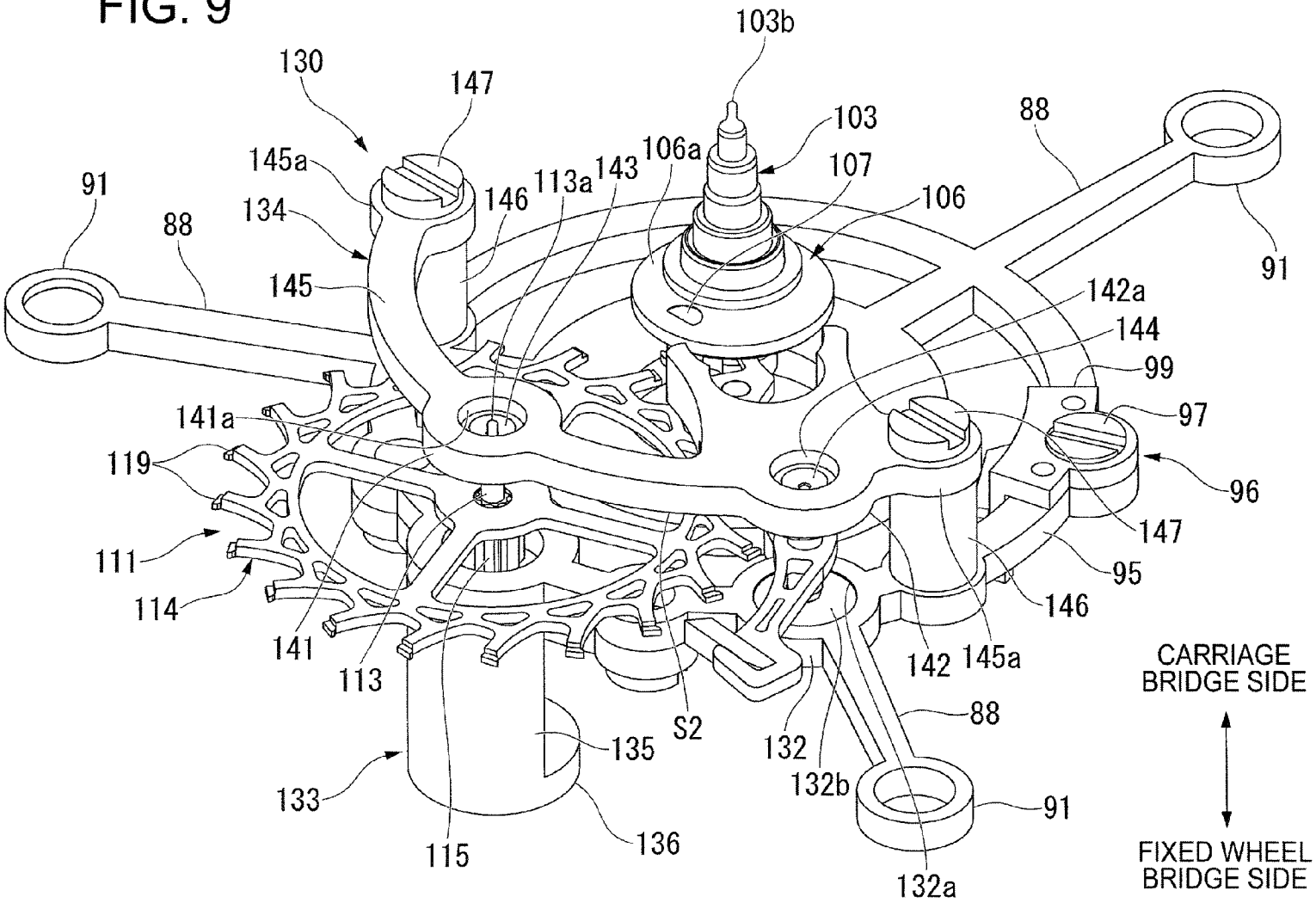
FIG. 9 is a perspective view of a bearing unit of an escapement mechanism according to the first embodiment of the present invention.

FIG. 9 is a perspective view of the escapement mechanism bearing unit 130.

As illustrated in FIGS. 7 to 9, the escapement mechanism bearing unit 130 is configured to have an axle body insertion portion 131 which is integrally molded on the support bar 95, a substantially disk-shaped bearing washer 132, a bearing 133 which is attached to the fixed wheel bridge 29 side of the support bar 95, an escapement mechanism support 134 which is attached to the carriage bridge 32 side of the support bar 95.

The axle body insertion portion 131 is arranged on a side radially opposite to the axle body insertion portion 51 of the outer carriage 33 across the first inner rotation body 83. In addition, the bearing washer 132 is arranged at a position which is adjacent to the axle body insertion portion 131 and in which the support bar 95 and the first arm 88 are connected to each other. A through-hole 132*a* penetrating in the thickness direction is formed in the substantial center of the bearing washer 132 in the radial direction, and a hole jewel 132*b* is disposed in the through-hole 132*a*.

In addition, the bearing 133 has a wall 135 which extends toward the fixed wheel bridge 29 side from a position corresponding to the axle body insertion portion 131 of the support bar 95. The wall 135 is inserted into the bearing unit insertion portion 65 formed in the outer carriage 33, and is formed to extend up to the fixed wheel & pinion 31. In addition, the wall 135 is formed in a substantially cross-sectional C-shape so that the radially inner side is open. A substantially disk-shaped bearing washer 136 is integrally molded on the inner peripheral surface side of the distal end of the wall 135 so as to be orthogonal to the wall 135. Then, a through-hole 136*a* penetrating in the thickness direction is formed in the substantial center of the bearing washer 136 in the radial direction, and a hole jewel 137 is disposed in the through-hole 136*a*.

In addition, a pair of mounting stays 138 extending to both sides across the wall 135 is integrally molded on the proximal end side of the wall 135. Substantially disk-shaped screw washers 138*a* are respectively and integrally molded in the distal end of the pair of mounting stays 138. The screw washer 138*a* is fastened and fixed to the support bar 95 by a screw 139.

In contrast, the escapement mechanism support 134 has two substantially disk-shaped bearing washers 141 and 142 at a position corresponding to the axle body insertion portion 131 and the bearing washer 132 which are formed in the support bar 95. Through-holes 141*a* and 142*a* penetrating in the thickness direction are formed in the substantial center of the bearing washers 141 and 142 in the radial direction. Hole jewels 143 and 144 are respectively disposed in the through-holes 141*a* and 142*a*.

In addition, the escapement mechanism support 134 has a mounting stay 145 which connects the respective bearing washers 141 and 142. The mounting stay 145 is formed in a substantially arc shape in a plan view taken in the axial direction so as to correspond to a shape of the support bar 95. Substantially disk-shaped screw washers 145*a* are respectively and integrally molded in both ends of the mounting stay 145. The screw washer 145*a* is attached to the support bar 95 via a spacer 146. Then, the screw washer 145*a* is fastened and fixed to the support bar 95 by a screw 147.

Here, the escapement mechanism support 134 is fixed to the support bar 95 via the spacer 146. Accordingly, a gap S2 is formed between the support bar 95 and the escapement mechanism support 134. The escapement mechanism 102 is disposed in the gap S2. In addition, the balance with hairspring 101 is disposed between the seismic bearings 87*a* and 87*b* of the inner carriage 34 configured as described above.

(Balance with Hairspring)

As illustrated in FIGS. 3 and 8, the balance with hairspring 101 includes a balance staff 103 which is rotatably supported by the seismic bearing 87*a* of the first inner carriage bearing 81 and the seismic bearing 87*b* of the second inner carriage bearing 82, a balance wheel 104 which is attached to the balance staff 103, and a hairspring 105. Power transmitted from the hairspring 105 causes the balance with hairspring 101 to be rotated forward and rearward at constant oscillation cycles.

The balance staff 103 is an axle body which is formed so that a diameter thereof is gradually decreased by a step difference as it goes from the substantial center in the axial direction toward both ends in the axial direction. Tenons 103*a* and 103*b* are respectively formed so as to protrude axially outward in both ends of the balance staff 103. The respective tenons 103*a* and 103*b* are rotatably supported by the respective seismic bearings 87*a* and 87*b*. In addition, the balance wheel 104 is externally fitted and fixed to a large diameter portion 103*c* in which an axial diameter in the substantial center in the axial direction is the largest. The balance wheel 104 and the balance staff 103 are integrated with each other so as not to be relatively rotatable. An outer flange 103*c*1 is formed on the first inner carriage bearing 81 side of the balance wheel 104 in the large diameter portion 103*c*. The outer flange 103*c*1 determines an axial position of the balance wheel 104.

Furthermore, a cylindrical double roller 106 is externally fitted and fixed to a side opposite to the balance wheel 104 of the outer flange 103*c*1. An annular rim portion 106*a* protruding radially outward is integrally molded in a side end of the large diameter portion 103*c* of the double roller 106. An impulse pin 107 (refer to FIG. 3) is disposed in the rim portion 106*a*. The impulse pin 107 is used for oscillating a pallet fork (to be described later) 112 configuring the escapement mechanism 102.

For example, the hairspring 105 is a flat hairspring wound spirally inside one plane. An inner end portion thereof is fixed to the second inner carriage bearing 82 side rather than the large diameter portion 103*c* of the balance staff 103 via a collet 108. In contrast, a stud 109 is attached to an outer end portion of the hairspring 105. The stud 109 is fixed to a stud support 110 disposed in the second carriage bearing 82. Then, the hairspring 105 fulfills a function of storing power transmitted from the escapement mechanism 102 to the double roller 106 and transmitting the power to the balance staff 103 and the balance wheel 104.

(Escapement Mechanism)

Figure 10:
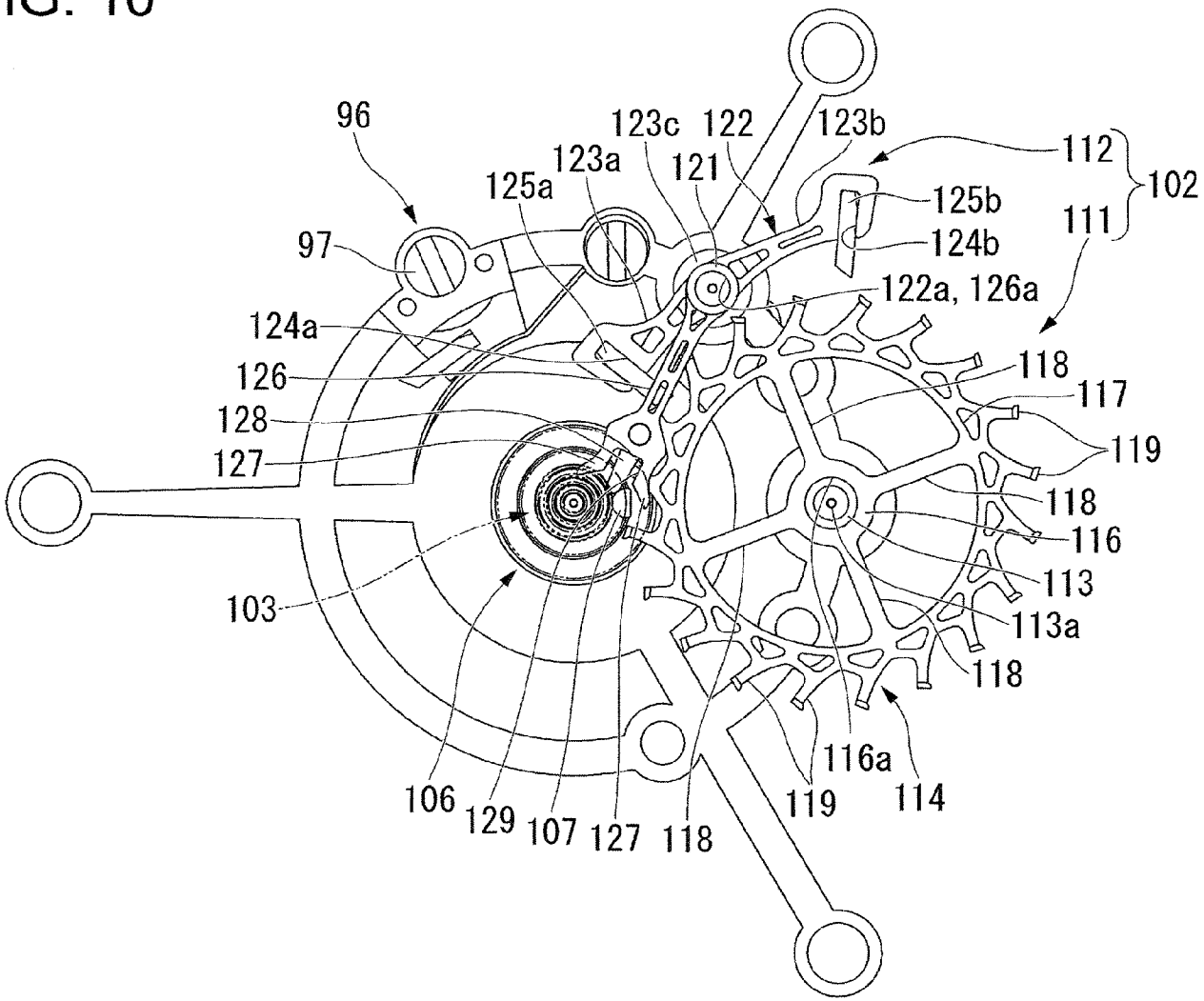
FIG. 10 is a plan view of the escapement mechanism according to the first embodiment of the present invention.

FIG. 10 is a plan view of the escapement mechanism 102.

As illustrated in FIGS. 3 and 10, the escapement mechanism 102 includes the escape wheel & pinion 111 and the pallet fork 112 which causes the escape wheel & pinion 111 to escape so as to be regularly rotated.

The escape wheel & pinion 111 includes an axle body 113, and an escape wheel 114 which is externally fitted and fixed to the axle body 113.

A first tenon 113*a* and a second tenon 113*b* whose diameters are respectively decreased by a step difference are integrally molded in both ends of the axle body 113. The axle body 113 is inserted into the axle body insertion portion 131 of the support bar 95, and the first tenon 113*a* is rotatably supported by the hole jewel 143 of the escapement mechanism support 134. In contrast, the second tenon 113*b* is rotatably supported by the hole jewel 137 of the bearing 133.

In addition, an escape pinion 115 is integrally molded on the bearing washer 136 side of the bearing 133 in the axle body 113. Here, the inner diameter of the support bar 95 in which the escapement mechanism bearing unit 130 is disposed is set to be substantially the same as the outer diameter of the tooth portion 31*d* of the fixed wheel & pinion 31. Accordingly, the escape pinion 115 is adapted to mesh with the tooth portion 31*d*.

As illustrated in detail in FIG. 10, the escape wheel 114 is formed of a material having a crystal orientation, such as a metal material and single crystal silicon, and is formed by means of a lithographie galvanoformung abformung (LICA) process in which an optical method such as electroforming and a photolithography technology is incorporated, deep reactive ion etching (DRIE), or metal injection molding (MIM).

The escape wheel 114 has a substantially annular hub 116 which is press-fitted to the axle body 113. The axle body 113 is press-fitted to a through-hole 116*a* formed in the hub 116. Then, the hub 116 is in an interposed state in the gap S2 between the support bar 95 and the escapement mechanism support 134.

A rim 117 which is formed in a ring shape so as to surround the hub 116 is disposed outside the hub 116 in the radial direction. The rim 117 and the hub 116 are connected to each other by multiple (four in this embodiment) spokes 118. The spokes 118 extend along the radial direction, and are arranged at equal intervals in the circumferential direction.

In addition, multiple (20 in this embodiment) teeth 119 which are formed in a special hook shape are formed to protrude radially outward, in the outer peripheral edge of the rim 117. Pallets 125*a* and 125*b* of the pallet fork 112 (to be described later) are engaged with or disengaged from the distal end of the teeth 119.

As illustrated in FIGS. 8 to 10, the pallet fork 112 includes a pallet staff 121, a body of pallet fork 122 and a pallet rod 126 which are externally fitted and fixed to the pallet staff 121.

The pallet staff 121 is an axle body which is rotatably supported by the hole jewel 132*b* disposed in the support bar 95 and a hole jewel 144 disposed in the escapement mechanism support 134.

For example, the body of pallet fork 122 is formed in such a manner that two pallet beams 123*a* and 123*b* formed by means of electroforming are connected to each other. A through-hole 122*a* which can be inserted into the pallet staff 121 is formed in a connection portion 123*c* between the two pallet beams 123*a* and 123*b*. The two pallet beams 123*a* and 123*b* are in a state of extending from the connection portion 123*c* toward the respectively opposite sides.

For example, as an electroforming metal for forming the body of pallet fork 122, it is possible to use high rigid chromium, nickel, and iron, and an alloy containing these materials.

Slits 124*a* and 124*b* are respectively formed in the distal end of the two pallet beams 123*a* and 123*b* so that the escape wheel & pinion 111 side is open. The pallets 125*a* and 125*b* are respectively bonded and fixed to the slits 124*a* and 124*b* by an adhesive. The pallet 125 is ruby formed in a substantially square column shape, and is in a state of protruding from the distal end of the respective pallet beams 123*a* and 123*b* toward the tooth portion 119 of the escape wheel 114.

In contrast, the pallet rod 126 is also formed by means of the electroforming, for example. An insertion hole 126*a* into which the pallet staff 121 can be inserted is formed in the proximal end thereof. Then, the pallet rod 126 is inserted into and fixed to the pallet staff 121 from the escapement mechanism support 134 side of the body of pallet fork 122. The pallet rod 126 is formed to extend from the pallet staff 121 toward the balance staff 103 side.

A pair of stag beetle-shaped portions 127 and a blade tip 128 arranged between the pair of stag beetle-shaped portions 127 are disposed in the distal end of the pallet rod 126. Then, a pallet receptacle 129 which the impulse pin 107 the balance with hairspring 101 is engaged with or disengaged from is formed inside the pair of stag beetle-shaped portions 127.

(Operation of Tourbillion with Constant Force Device)

Next, an operation of the tourbillion with constant force device 30 will be described.

First, referring to FIGS. 8 to 10, an operation of the balance with hairspring 101 and the escapement mechanism 102 which are mounted on the inner carriage 34 will be described. The balance with hairspring 101 receives a rotation force of the escape wheel & pinion 111 via the impulse pin 107, and is freely oscillated by this rotation force and a spring force of the hairspring 105. If the balance with hairspring 101 is freely oscillated, the pallet rod 126 forming the pallet receptacle 129 which can be engaged with or disengaged from the impulse pin 107 is oscillated from side to side around the pallet staff 121.

Then, the body of pallet fork 122 fixed to the pallet staff 121 is also oscillated integrally with the pallet rod 126. If the body of pallet fork 122 is oscillated, the two pallets 125*a* and 125*b* alternately and repeatedly come into contact with the tooth portion 119 of the escape wheel 114. In this manner, the escape wheel & pinion 111 is rotated at a constant speed at all times.

Subsequently, referring to FIG. 11, an operation of the outer carriage 33 and the inner carriage 34 will be described.

Figures 11A, 11B, 11C, 11D:
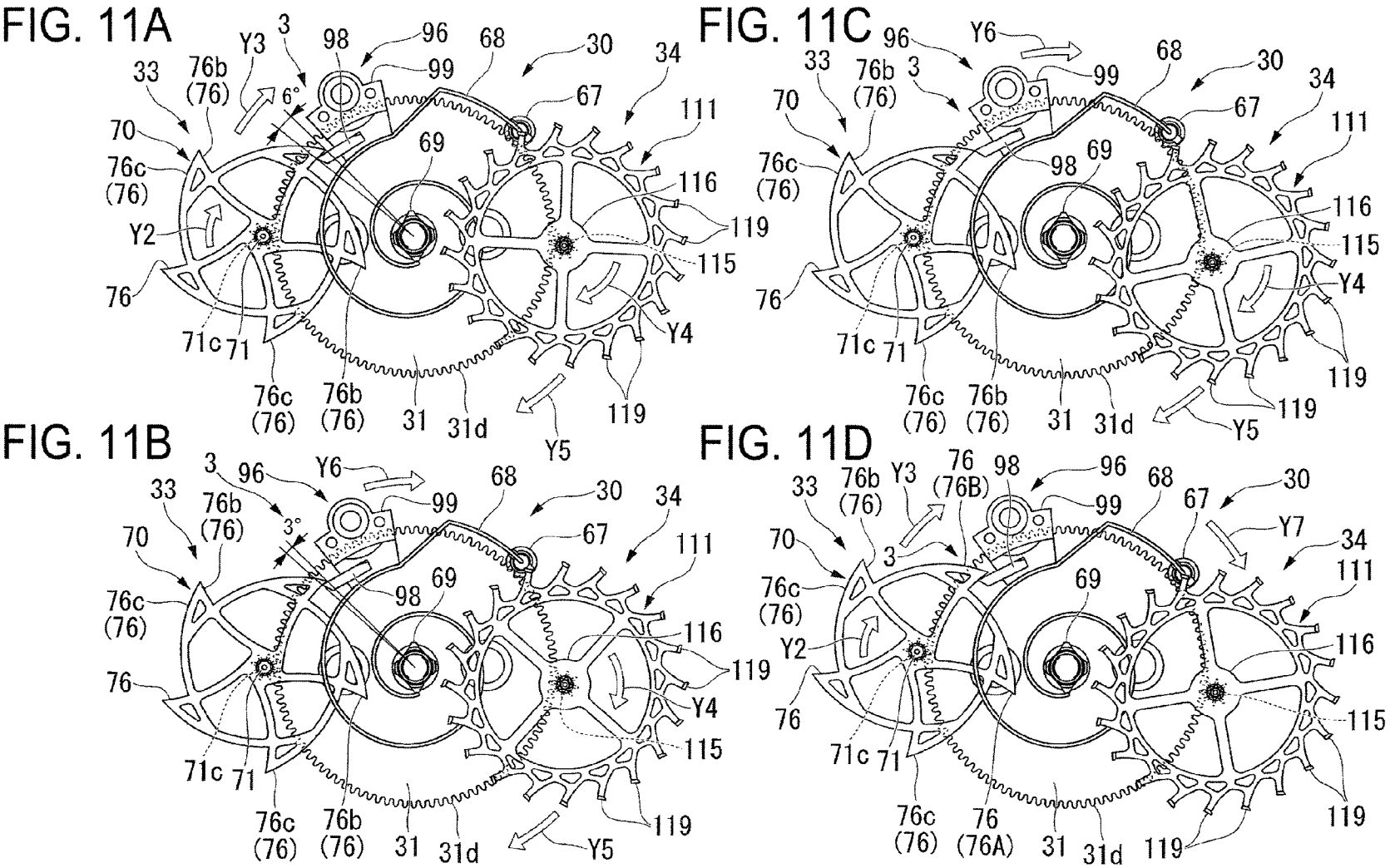
FIG. 11 is a view for illustrating an operation of a stop wheel & pinion, a stopper 96, and an escape wheel & pinion according to the first embodiment of the present invention, and FIGS. 11(*a*) to 11(*d*) illustrate a successive change.

FIGS. 11(*a*) to 11(*d*) are views for illustrating an operation of the stop wheel & pinion 70 disposed in the outer carriage 33, and an operation of the stopper 96 and the escape wheel & pinion 111 which are disposed in the inner carriage 34.

First, a rotation force received by the outer carriage 33 and an operation of the stop wheel & pinion 70 receiving the rotation force will be described.

In the outer carriage 33, since the external gear 41 meshes with the fifth wheel & pinion 28, the rotation force of the barrel wheel 22 is transmitted to the outer carriage 33 via the front train wheel. In addition, in the stop wheel & pinion 70, the stop pinion 71*c* meshes with the tooth portion 31*d* of the fixed wheel & pinion 31. Therefore, since the outer carriage 33 is rotated, the stop wheel & pinion 70 rotates about the axial center of the stop pinion 71*c* (clockwise direction in FIG. 11(*a*), refer to arrow Y2), and revolves around the fixed wheel & pinion 31 (counterclockwise direction in FIG. 11(*a*), refer to arrow Y3).

Next, a rotation force received by the inner carriage 34 and an operation of the escape wheel & pinion 111 receiving the rotation force will be described.

The inner carriage 34 is supported so as to be rotatable with respect to the outer carriage 33, and is connected to the outer carriage 33 via the constant force spring 68. Therefore, the inner carriage 34 is rotated with respect to the outer carriage 33 by receiving a biasing force of the constant force spring 68. In addition, in the escape wheel & pinion 111, the escape pinion 115 meshes with the tooth portion 31*d* of the fixed wheel & pinion 31. Therefore, since the inner carriage 34 is rotated, the escape wheel & pinion 111 rotates about the axial center of the escape wheel & pinion 111 (clockwise direction in FIG. 11(*a*), refer to arrow Y4), and revolves around the fixed wheel & pinion 31 (counterclockwise direction in FIG. 11(*a*), refer to arrow Y5).

Here, the escape wheel & pinion 111 configures the escapement mechanism 102, and is adapted to be rotated at a constant speed at all times by the pallet fork 112 or the balance with hairspring 101. That is, since the escape wheel & pinion 111 is rotated in a constant speed, the inner carriage 34 which rotatably supports the escape wheel & pinion 111 is rotated at a constant speed. Specifically, the escape wheel & pinion 111 is rotated at a constant speed so that the inner carriage 34 is rotated once per minute. In other words, the inner carriage 34 is rotated six times per second. Since the inner carriage 34 is rotated once per minute, the center wheel & pinion 25 is rotated once per hour.

Here, the hook 76 of the stop wheel & pinion 70 is repeatedly engaged with or disengaged from the pawl 98 of the stopper 96.

As illustrated in FIG. 11(*a*), in an initial state where the hook 76 of the stop wheel & pinion 70 is engaged with the pawl 98 of the stopper 96 (hereinafter, this initial state is referred to as a Os point), a range within the hook 76 which corresponds to an extent of six degrees about the rotation axis of the outer carriage 33 and the inner carriage 34 is engaged with the pawl 98. More specifically, in a state where the distal end of the pawl 98 is in contact with a lateral side 76*b* (refer to FIG. 6) of the hook 76, the hook 76 and the pawl 98 are engaged with each other.

The extent of six degrees means an extent of an angle in which the inner carriage 34 is rotated in one second.

In this Os point, the rotation of the stop wheel & pinion 70 is regulated by the stopper 96. Accordingly, the outer carriage 33 is in a stopped state. Then, the biasing force of the constant force spring 68 causes only the inner carriage 34 to be rotated. Since the inner carriage 34 is rotated, the escape wheel & pinion 111 is continuously rotated.

Subsequently, as illustrated in FIG. 11(*b*), if 0.5 seconds elapse from the Os point, the inner carriage 34 is rotated three times. Then, the stopper 96 fixed to the inner carriage 34 is also moved integrally with the inner carriage 34 (clockwise direction in FIG. 11(*b*), refer to arrow Y6). Therefore, the pawl 98 of the stopper 96 is moved to slide on the lateral side 76*b* on the front side of the hook 76 in a direction for disengagement. Then, a range within the hook 76 which corresponds to an extent of three degrees about the rotation axis of the outer carriage 33 and the inner carriage 34 is in an engaged state with the pawl 98.

Subsequently, as illustrated in FIG. 11(*c*), if it is the time immediately before one second elapses from the Os point, that is, if approximately 0.99 seconds elapse, the pawl 98 is further moved to slide on the lateral side 76*b* on the front side of the hook 76, a state where the hook 76 and the pawl 98 are engaged with each other becomes a state immediately before the hook 76 and the pawl 98 are disengaged from each other. Then, next moment, that is, if one second elapses, the hook 76 and the pawl 98 are in a state of being disengaged from each other.

Then, as illustrated in FIG. 11(*d*), the outer carriage 33 is rotated. In response to this rotation, the stop wheel & pinion 70 rotates about the axial center of the stop pinion 71*c*, and revolves around the fixed wheel & pinion 31. In other words, the stop wheel & pinion 70 rotates while being moved toward the stopper 96. Then, the stop wheel & pinion 70 is stopped again in such a manner that the hook 76 (76A) engaged with the pawl 98 at the Os point is engaged with the pawl 98 of the next hook 76 (76B).

A angle in which the outer carriage 33 is rotated until the stop wheel & pinion 70 is rotated while the hook 76 and the pawl 98 are disengaged from each other and the stop wheel & pinion 70 is stopped represents six degrees.

Here, since the outer carriage 33 is rotated, the stud 67 fixed to the outer carriage 33 is also moved integrally with the outer carriage 33 (clockwise direction in FIG. 11(*d*), refer to arrow Y7). Since the stud 67 is moved, the constant force spring 68 is wound up. Specifically, the constant force spring 68 is wound up to an extent where the outer carriage 33 is rotated by six degrees.

Then, in a state where the constant force spring 68 is wound up, the outer carriage 33 (stop wheel & pinion 70) is stopped and the biasing force of the constant force spring 68 causes the inner carriage 34 to be rotated. Since this operation is repeated, the inner carriage 34 and the escape wheel & pinion 111 are continuously rotated at a constant speed.

As described above, in the above-described first embodiment, the outer carriage 33 and the inner carriage 34 which are supported to be rotatable with respect to the fixed wheel & pinion 31 and are relatively rotatable are provided, and the stop wheel & pinion 70 is disposed in the outer carriage 33. In contrast, the stopper 96 for stopping or resuming the rotation of the stop wheel &pinion 70 is disposed in the inner carrier 34. Then, in response to the rotation of the outer carriage 33, the stop wheel & pinion 70 is configured to rotate about the axial center of the stop pinion 71*c* and to revolve around the fixed wheel & pinion 31. In contrast, the stopper 96 is configured to be moved integrally with the inner carriage 34. That is, the stop wheel & pinion 70 is configured to perform a planetary movement (revolving while rotating) around the fixed wheel & pinion 31.

Therefore, according to the above-described first embodiment, it is possible to stop or resume the rotation of the stop wheel & pinion 70 while rotating the stopper 96 integrally with the inner carriage 34 and further while rotating the stop wheel & pinion 70 integrally with the outer carriage 33. Accordingly, it is not necessary to use an oscillating member as in the related art in order to control the rotation of the stop wheel & pinion 70. To that extent, it is possible to decrease a power loss. In other words, since the stop wheel & pinion 70 and the inner carriage 34 are in close contact with each other, it is possible to decrease the loss received by the inner carriage 34 from the stop wheel & pinion 70. In addition, the movement of the stopper 96 becomes the rotation movement similar to that of the stop wheel & pinion 70. Therefore, it is possible to decrease the power loss, and it is possible to simplify a transmission route between the stop wheel & pinion 70 and the inner carriage 34. Accordingly, it is possible to ensure more stable rotation torque of the inner carriage. In this manner, a rate of the balance with hairspring can be stabilized, thereby ensuring higher accuracy.

In addition, the tourbillion with constant force device 30 is configured so that in order to cause the stop wheel & pinion 70 to rotate and to revolve around the fixed wheel & pinion 31, the stop pinion 71*c* is disposed in the stop wheel & pinion 70, and the stop pinion 71*c* is caused to mesh with the tooth portion 31*d* of the fixed wheel & pinion 31. Therefore, it is possible to cause the stop wheel & pinion 70 and the stopper 96 to be engaged with or disengaged from each other by using a simple structure. Accordingly, it is possible to reduce the weight, the size, and the costs of the tourbillion with constant force device 30. In addition, it becomes possible to adjust a rotation progress degree of the stop wheel & pinion 70 by using a simple structure. Accordingly, it is possible to effectively utilize a space around the outer carrier 33 and the stop wheel & pinion 70. Then, the tourbillion with constant force device 30 can be efficiently laid out.

Furthermore, the lateral side 76*b* on the front side in the hook 76 of the stop wheel 72 is formed in an arc shape, and the center of the arc is set to be coaxial with the rotation center of the outer carriage 33. That is, the shape of the lateral side 76*b* on the front side is the same as a movement locus of the pawl 98 of the stopper 96 which is moved to slide on the lateral side 76*b*. Therefore, when the pawl 98 is moved to slide on the lateral side 76*b*, a friction loss is suppressed, and an unnecessary load is not applied to the stopper 96.

That is, for example, if the hook 76 protrudes further forward in a rotation direction Y1 (refer to FIG. 6) of the outer carriage 33 than that in the above-described first embodiment, when the pawl 98 is moved to slide in the direction for disengagement, a force for pushing the stop wheel 72 back in a rearward moving direction is required.

Therefore, the lateral side 76*b* on the front side of the hook 76 is formed in an arc shape, and the center of the arc is set to be coaxially with the rotation center of the outer carriage 33. In this manner, the unnecessary load is not applied to the stop wheel 72. Accordingly, it is possible to improve the operation efficiency of the tourbillion with constant force device 30.

The surface which comes into contact with the lateral side 76*b* of the hook 76 in the pawl 98 may be formed in an arc shape, similar to the lateral side 76*b*. According to this configuration, the hook 76 and the pawl 98 come into surface contact with each other. In this manner, it is possible to prevent high pressure from being locally applied to the hook 76 and the pawl 98. Therefore, it is possible to lengthen the durability of the stop wheel 72 or the pawl 98.

In addition, according to the above-described first embodiment, the balance with hairspring 101 is disposed in the inner carriage 34. Accordingly, the balance with hairspring 101 can be rotated together with the inner carriage 34. Therefore, for example, it is possible to decrease influence of gravity which may be caused by a user changing an orientation of the mechanical timepiece 1, that is, influence of gravity which is caused by an orientation of the balance with hairspring 101. Accordingly, it is possible to suppress variations in the oscillation cycles of the balance with hairspring 101 which may be caused by a direction of gravity.

In addition, the tenon 37*b* of the first outer rotation body 37 and the tenon 39*b* of the second outer rotation body 39 which rotatably support the outer carrier 33, and the tenon 83*c* of the first inner rotation body 83 and the tenon 85*b* of the second inner rotation body 85 which rotatably support the inner carrier 34 are all arranged coaxially. Therefore, a transmission distance is effectively shortened between the stop wheel & pinion 70 and the inner carriage 34. Accordingly, it is possible to further decrease the power loss.

Incidentally, according to the constant force device in the related art, if a phase shift between the escape wheel & pinion and the tensioning ring (corresponding to the phase shift between the outer carriage 33 and the inner carriage 34 in the present embodiment) is increased, even if the barrel wheel is wound up again, the stop wheel & pinion and the pallet of the second anchor are eventually engaged with each other before the pre-tensioning spiral spring (corresponding to the constant force spring in the present embodiment) disposed between the escape wheel & pinion and the tensioning ring has a predetermined winding amount (initial winding amount). Consequently, according to the constant force device in the related art, if the phase shift between the escape wheel & pinion and the tensioning ring is increased, it is difficult to wind up the pre-tensioning spiral spring so as to have the predetermined winding amount. Accordingly, the constant force device in the related art requires an essential configuration of a phase shift regulation mechanism for preventing the phase shift from being increased beyond a predetermined level between the escape wheel & pinion and the tensioning ring.

However, according to the present embodiment, the stopper 96 is fixed to the inner carriage 34, and the stopper 96 is moved to rotate about the rotation axis of the inner carriage 34. Therefore, even when the phase shift is increased between the outer carriage 33 and the inner carriage 34, there is no possibility that the stop wheel 72 and the stopper 96 are engaged with each other until the constant force spring 68 has the predetermined winding amount. For this reason, in a case where the phase shift regulation mechanism 160 is not provided, it is possible to maintain the winding amount of the constant force spring 68 to be always constant.

First Modification Example of First Embodiment

Next, referring to FIGS. 12 and 13, a first modification example of the first embodiment will be described.

Figure 12:
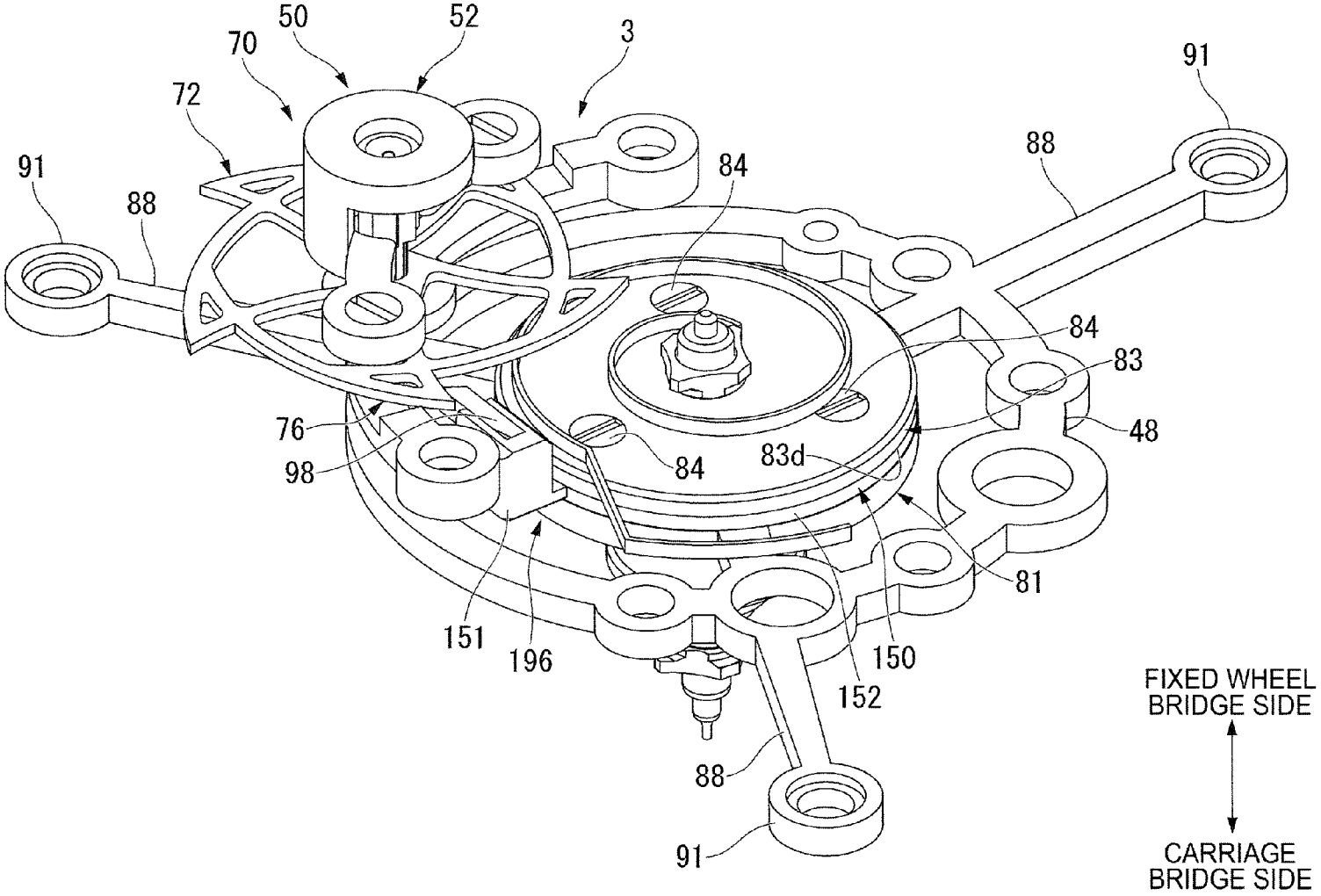
FIG. 12 is a perspective view when a main portion according to a first modification example of the first embodiment of the present invention is viewed from a fixed wheel bridge side.
Figure 13:
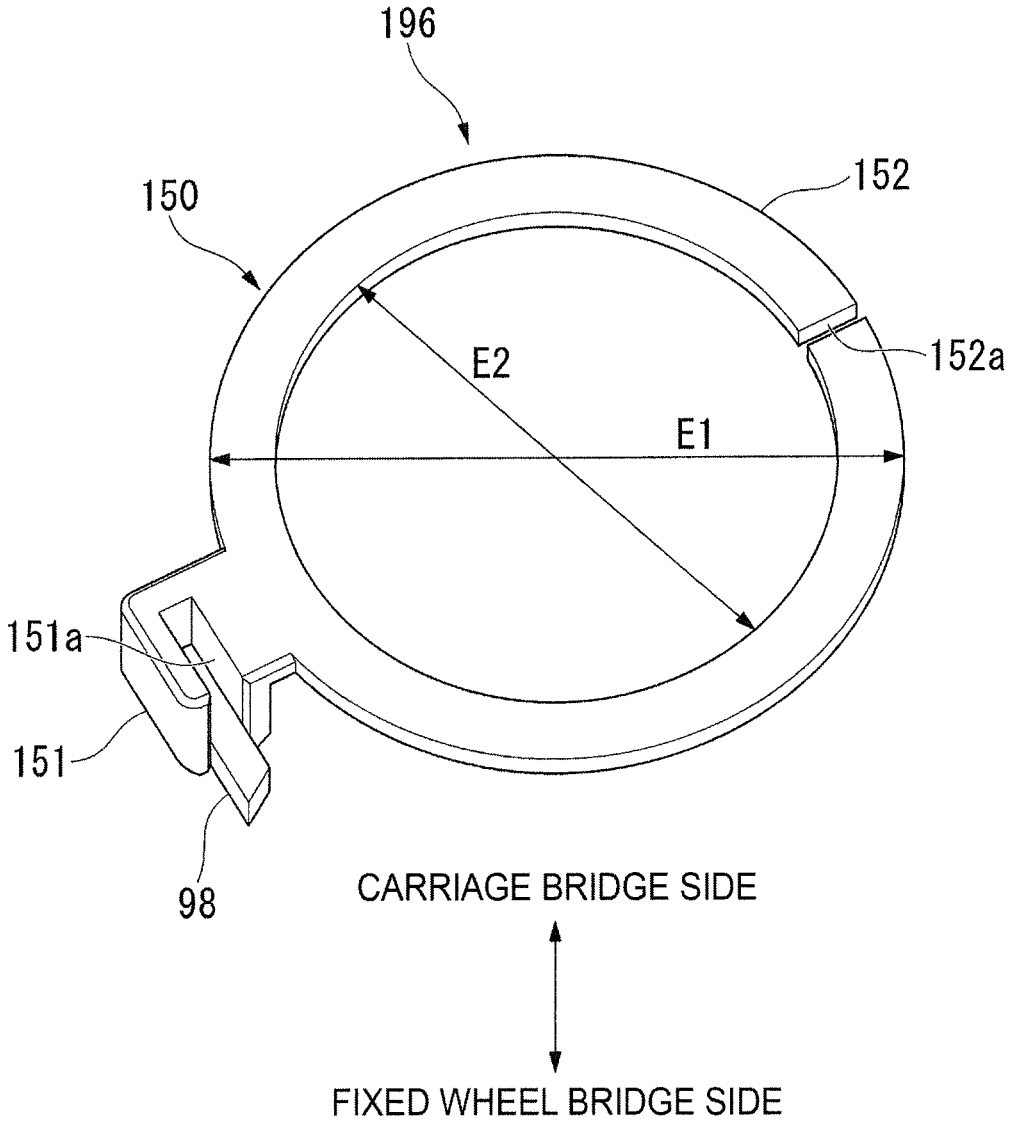
FIG. 13 is a perspective view of a stopper according to the first modification example of the first embodiment of the present invention.

FIG. 12 is a perspective view when a portion of the inner carriage 34 and the stop wheel & pinion 70 disposed in the outer carriage 33 according to the first modification example of the first embodiment is viewed from the fixed wheel bridge 29 side, and FIG. 13 is a perspective view of a stopper 196 according to the first modification example of the first embodiment. The same reference numerals are given to elements which are the same as those in the above-described first embodiment, and description thereof will be omitted (in the following description, the same also applied to each modification example of the first embodiment, second embodiment, and a modification example of a second embodiment).

As illustrated in FIGS. 12 and 13, a different point between the first embodiment and the first modification example of the first embodiment is that a shape of the stopper 96 of the first embodiment is different from a shape of the stopper 196 of the first modification example of the first embodiment.

More specifically, the stopper 196 is configured to have the pawl 98 which comes into contact with the hook 76 of the stop wheel & pinion 70, and a support portion 150 which supports the pawl 98. The support portion 150 is configured to have a substantially rectangular-shaped pawl holder 151 which holds the pawl 98, and a ring-shaped fixing portion 152 which is integrally molded on one side of the pawl holder 151.

A pawl accommodating recess 151*a* is formed in the pawl holder 151 so that the stop wheel & pinion 70 side is open, and the pawl 98 is accommodated therein.

Then, in the stopper 196, the fixing portion 152 is interposed and fixed between the first inner carriage bearing 81 and the first inner rotation body 83. More specifically, in the stopper 196, the fixing portion 152 is arranged between the first inner carriage bearing 81 and the first inner rotation body 83. Then, the first inner rotation body 83 is fastened and fixed to the first inner carriage bearing 81 by a screw 84.

Here, an outer diameter E1 of the fixing portion 152 is set to be substantially the same as the outer diameter of the first inner carriage bearing 81. In addition, an inner diameter E2 of the fixing portion 152 is set so that an inner peripheral edge thereof is located further outside in the radial direction than an arrangement position of the screw 84. In this manner, the fixing portion 152 and the screw 84 do not interfere with each other.

Furthermore, a slit 152*a* is formed in the fixing portion 152, thereby fulfilling a spring function.

In addition, a stepped portion 83*d* which receives the fixing portion 152 is formed at a position corresponding to the fixing portion 152, in the base 83*a* of the first inner rotation body 83. A depth of the step difference in the stepped portion 83*d* is set to be slightly larger than a thickness of the fixing portion 152.

Based on this configuration, in a state where the first inner rotation body 83 is fastened and fixed to the first inner carriage bearing 81 by the screw 84, the fixing portion 152 is accommodated inside the stepped portion 83*d* of the first inner rotation body 83 in a state where the fixing portion 152 is elastically deformed so as to slightly expand. Then, the fixing portion 152 is held by a friction force, which is generated by a spring force, between the fixing portion 152, and the first inner carriage bearing 81 and the first inner rotation body 83. In this state, the fixing portion 152 is adapted to be rotatable by receiving a predetermined load. Therefore, a position of the pawl holder 151 in the circumferential direction is minutely adjusted, and the pawl holder 151 is aligned at a predetermined position. In this manner, the pawl holder 151 can be held at this position.

According to this configuration, the effect which is the same as that in the above-described first embodiment can be obtained. In addition to this, without changing a radial position where the stop wheel 72 of the stop wheel & pinion 70 and the pawl 98 of the stopper 196 are engaged with each other, it is possible to adjust a relative position (phase) between the outer carriage 33 and the inner carriage 34 at the moment the stop wheel 72 and the pawl 98 of the stopper 196 are disengaged from each other.

Second Modification Example of First Embodiment

Next, referring to FIGS. 14 to 16, a second modification example of the first embodiment will be described.

Figure 14:
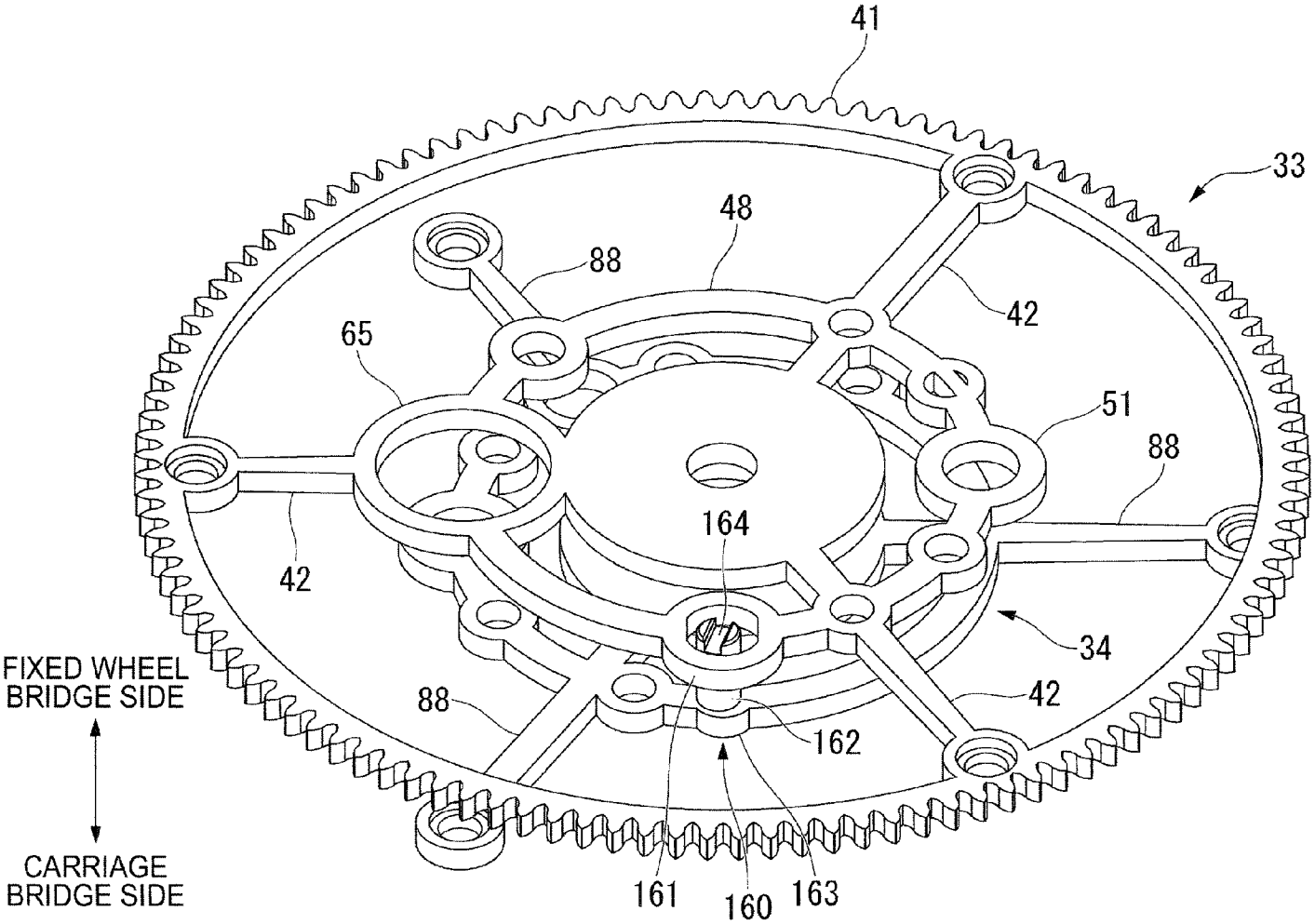
FIG. 14 is a perspective view when a main portion according to a second modification example of the first embodiment of the present invention is viewed from the fixed wheel bridge side.

FIG. 14 is a perspective view when a portion of the outer carriage 33 and a portion of the inner carriage 34 according to the second modification example of the first embodiment are viewed from the fixed wheel bridge 29 side.

As illustrated in the drawing, a different point between the first embodiment and the second modification example of the first embodiment is that only the second modification example is provided with the phase shift regulation mechanism 160 which controls the phase shift between the outer carriage and the inner carriage 34 so as to fall within a predetermined angle range.

The phase shift regulation mechanism 160 includes a regulation ring 161 which is integrally molded in the support bar 48 of the outer carriage 33, and an eccentric pin 162 which is disposed in the support bar 95 of the inner carriage 34 and is inserted into the regulation ring 161.

The regulation ring 161 is arranged between the bearing unit insertion portion 65 on the support bar 48 and the axle body insertion portion 51. In contrast, a disk-shaped pin fixing portion 163 is integrally formed at a position corresponding to the regulation ring 161 in the axial direction, in the support bar 95 of the inner carriage 34. The eccentric pin 162 is fixed to the pin fixing portion 163 so as to protrude toward the regulation ring 161.

Figure 15:
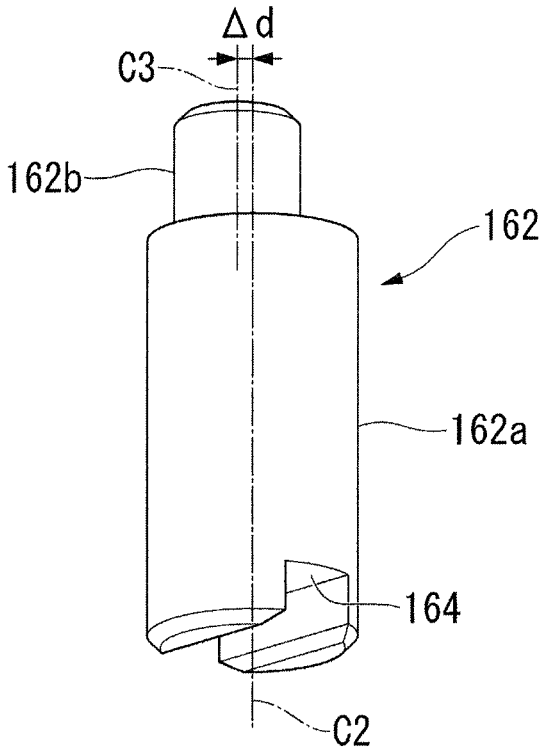
FIG. 15 is a perspective view of an eccentric pin according to the second modification example of the first embodiment of the present invention.
Figure 16:
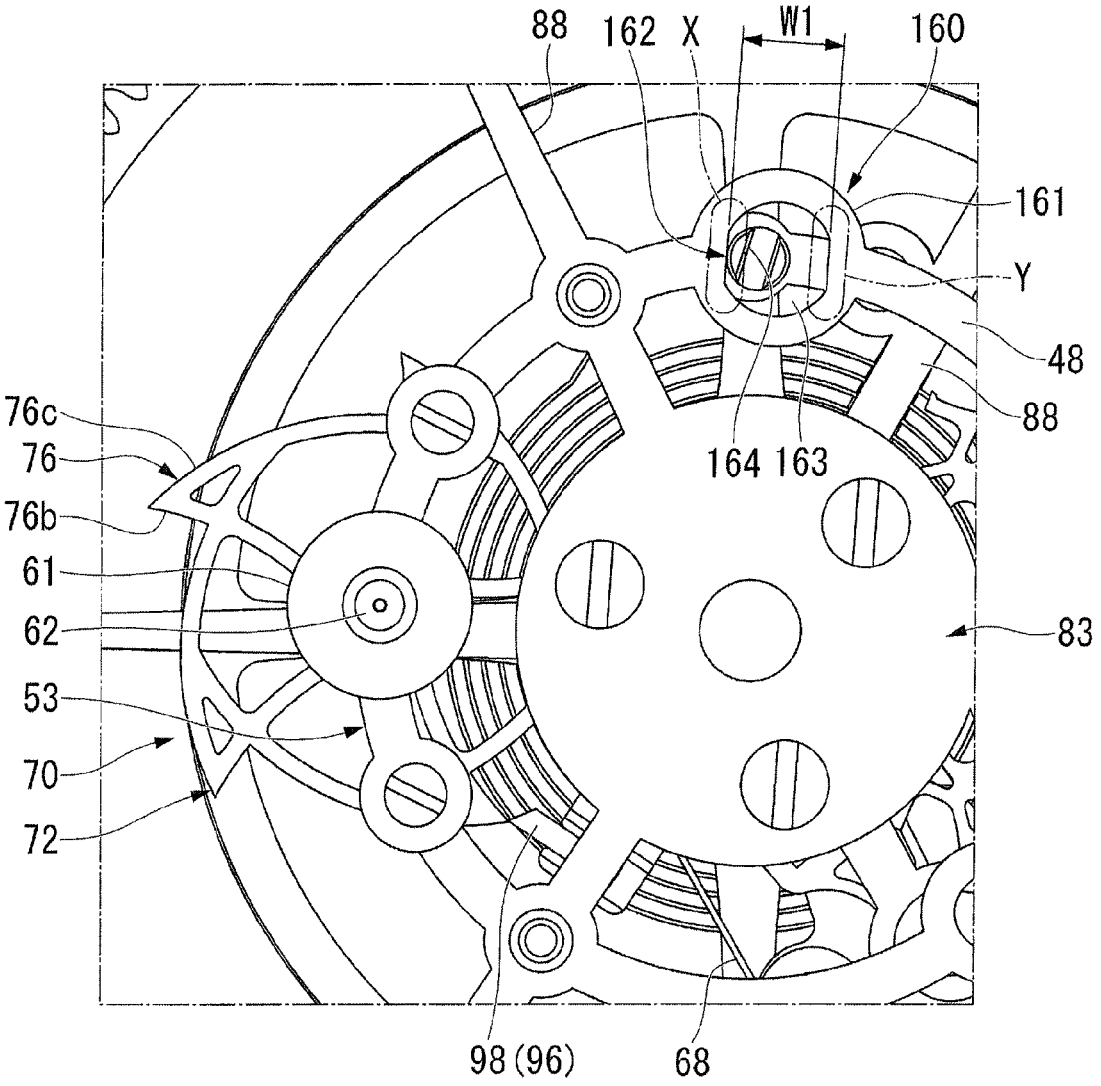
FIG. 16 is a plan view of a phase shift regulation mechanism according to the second modification example of the first embodiment of the present invention.

FIG. 15 is a perspective view of the eccentric pin 162, and FIG. 16 is a plan view of the phase shift regulation mechanism 160.

As illustrated in FIG. 15, the eccentric pin 162 is configured to have a pin main body 162*a* and a fixing pin 162*b* which is integrally molded in the proximal end of the pin main body 162*a*. Then, the fixing pin 162*b* is press-fitted to the pin fixing portion 163 of the inner carriage 34, thereby fixing the eccentric pin 162 to the inner carriage 34. The press fitting described herein is so-called light press fitting. The eccentric pin 162 is press-fitted to such an extent that the eccentric pin 162 can be rotated around the axial center of the fixing pin 162*b*.

Here, an axial center C2 of the pin main body 162*a* and an axial center C3 of the fixing pin 162*b* are shifted from each other by Δd. In addition, a recess 164 is formed in the distal end of the pin main body 162*a* along the radial direction. For example, the eccentric pin 162 can be rotated by using a flathead screwdriver.

In contrast, as illustrated in FIG. 16, an inner peripheral surface of the regulation ring 161 has a shape in which both sides in the circumferential direction are subjected to two-way milling. A width W1 of the two-way milling is set so that a rotation angle of the inner carriage 34 with respect to the outer carriage 33 falls within a predetermined angle when the inner carriage 34 is rotated with respect to the outer carriage 33 and the eccentric pin 162 comes into contact with the inner peripheral surface of the regulation ring 161.

For example, it is preferable that this predetermined angle be approximately six degrees. The six degrees represent an angle (one second in time) in which the stop wheel 72 of the stop wheel & pinion 70 and the pawl 98 of the stopper 96 are disengaged from each other. The predetermined angle is sufficiently satisfied if the rotation angle of the inner carriage 34 with respect to the outer carriage 33 is six degrees. In addition, the reason why the predetermined angle is set to be approximately six degrees is that a manufacturing error occurs in each component, in practice. For this reason, the angle is obtained by adding a clearance for absorbing the manufacturing error thereto.

Here, it is possible to adjust an amount of the circumferential shift between the axial center C2 of the pin main body 162*a* and the axial center C3 of the fixing pin 162*b* by rotating the eccentric pin 162. Therefore, even if the manufacturing error occurs in the regulation ring 161, by rotating the eccentric pin 162, it is possible to adjust a regulation position for the rotation of the inner carriage 34 with respect to the outer carriage 33, that is, it is possible to very accurately adjust a position which can regulate the rotation of the inner carriage 34.

Furthermore, even when the position of the stopper 96 is adjusted in order to adjust the position of the inner carriage 34 with respect to the outer carriage 33, it is possible to adjust the position of the eccentric pin 162 so that the rotation of the inner carriage 34 can be regulated at the position corresponding thereto.

Therefore, according to the second modification example of the above-described first embodiment, the effect which is the same as that in the above-described first embodiment can be obtained. In addition to this, for example, even when the mechanical timepiece 1 is dropped and receives an external impact, it is possible to prevent the pawl 98 of the stopper 96 from being damaged by colliding with the lateral side 76*c* of the stop wheel 72 due to the reverse rotation of the inner carriage 34, or the apex P1 of the hook 76 of the stop wheel 72 from being damaged by colliding with the stopper 96. In addition, when a train wheel is stopped for setting hands such as a minute hand or a hour hand (both of these are not illustrated), it is possible to prevent the inner carriage 34 from unnecessarily go ahead. Accordingly, it is possible to reliably stabilize the operation of the tourbillion with constant force device 30.

In addition, it is possible to prevent delay in the phase of the outer carriage 33 with respect to the inner carriage 34. Therefore, for example, even when a second hand is disposed in the outer carriage 33, it is possible to prevent seriously misaligned display of the second hand.

To be more specific, if the main spring (not illustrated) accommodated in the barrel wheel 22 is loosened, the rotation force transmitted to the outer carriage 33 is insufficient. Consequently, the force of the constant force spring 68 (force in a direction where the constant force spring 68 is loosened) prevails against the rotation force, thereby causing a large phase shift of the outer carriage 33 with respect to the inner carriage 34. That is, the phase of the outer carriage 33 with respect to the inner carriage 34 is considerably delayed (hereinafter, the delay in the phase is simply referred to as delay in phase). However, it is possible to regulate the delay in phase of the outer carriage 33 with respect to the inner carriage 34 so as to fall within six degrees, for example, by disposing the phase shift regulation mechanism 160. Accordingly, it is possible to suppress time display deviation of the second hand so as to fall within one second.

In addition, when the main spring of the barrel wheel 22 is wound up again from the loosened state of the main spring of the barrel wheel 22, the rotation force is rapidly applied to the outer carriage 33, thereby causing the outer carriage 33 to be vigorously rotated. Then, the stop wheel 72 is caused to collide with the stopper 96.

At this time, if the delay in phase of the outer carriage 33 with respect to the inner carriage 34 is considerable, the impact applied to the stopper 96 and the stop wheel 72 increases to that extent. However, it is possible to decrease the delay in phase of the outer carriage 33 with respect to the inner carriage 34 by disposing the phase shift regulation mechanism 160. Therefore, it is possible to prevent the stopper 96 or the stop wheel 72 from being damaged by the impact.

As described above, two surfaces subjected to the two-way milling in the regulation ring 161 configuring the phase shift regulation mechanism 160 is configured to have largely different roles depending on a movement direction of the eccentric pin 162.

That is, within the two surfaces subjected to the two-way milling in the regulation ring 161, a surface (refer to an X portion in FIG. 16) which regulates a rotation movement in a direction where the phase of the outer carriage 33 is delayed with respect to the inner carriage 34 (rotation movement in a direction where the constant force spring 68 in the outer carriage 33 is unwound) has a role for suppressing the time display deviation. In addition, the surface has a role for preventing the stopper 96 or the stop wheel 72 from being damaged by the impact when the barrel wheel 22 is wound up.

In contrast, within the two surfaces subjected to the two-way milling in the regulation ring 161, a surface (refer to a Y portion in FIG. 16) which regulates a rotation movement in a direction where the phase of the outer carriage 33 is quickened with respect to the inner carriage 34 (rotation movement in a direction where the constant force spring 68 in the outer carriage 33 is wound up) has a role for preventing the stop wheel & pinion 72 and the stopper 96 from being damaged since the stopper 96 collides with the stop wheel & pinion 72 when a drop impact causes the inner carriage 34 to be rotated rearward.

In the second modification example of the above-described first embodiment, a case has been described where the regulation ring 161 is arranged between the bearing unit insertion portion 65 on the support bar 48 and the axle body insertion portion 51. However, without being limited thereto, the position of the regulation ring 161 can be set to be any desired position on the support bar 48. In addition, the position of the eccentric pin 162 can also be arbitrarily set depending on the position of the regulation ring 161.

Furthermore, the eccentric pin 162 may be disposed in the outer carriage bearings 35 and 36 of the outer carriage 33 and the outer rotation bodies 37 and 39, and an elliptical hole (ellipse) into which the eccentric pin 162 can be inserted may be formed in the inner carriage bearings 81 and 82 and the inner rotation bodies 83 and 85 of the inner carriage 34. In this manner, the hole may be allowed to function as the regulation ring 161. In addition, the eccentric pin 162 may be disposed in the inner carriage bearings 81 and 82 and the inner rotation bodies 83 and 85, and an elliptical hole into which the eccentric pin 162 can be inserted may be formed in the outer carriage bearings 35 and 36 and the outer rotation bodies 37 and 39.

In addition, in the second modification example of the above-described first embodiment, a case has been described where the phase shift regulation mechanism 160 is configured to have the regulation ring 161 and the eccentric pin 162 inserted to the regulation ring 161. However, without being limited thereto, a configuration may be adopted which can regulate the phase shift between the outer carriage 33 and the inner carriage 34. For example, pins which are different from the eccentric pin 162 may be respectively disposed at positions corresponding to the two surfaces of the regulation ring 161 which are subjected to the two-way milling. In this manner, a configuration may be adopted where these pins regulate the movement of the eccentric pin 162.

In addition, in the second modification example of the above-described first embodiment, a case has been described where the regulation ring 161 can regulate the phase shift of the outer carrier 33 with respect to the inner carrier 34, for example, so as to fall within six degrees. However, without being limited thereto, depending on the role of the regulation ring 161, a shape of the regulation ring 161 can be arbitrarily changed.

That is, for example, when the regulation ring 161 accurately regulates only the rotation movement in the direction where the phase of the outer carriage 33 is delayed with respect to the inner carrier 34, within the two surfaces of the regulation ring 161 which are subjected to the two-way milling, only the position of the surface (refer to an A portion in FIG. 16) which regulates the rotation movement in the direction where the phase is delayed may be accurately formed.

In contrast, when the regulation ring 161 accurately regulates only the rotation movement in the direction where the phase of the outer carriage 33 is quickened with respect to the inner carrier 34, within the two surfaces of the regulation ring 161 which are subjected to the two-way milling, only the position of the surface (refer to a B portion in FIG. 16) which regulates the rotation movement in the direction where the phase is quickened may be accurately formed.

Third Modification Example of First Embodiment

Next, referring to FIG. 17, a third modification example of the first embodiment will be described.

Figure 17:
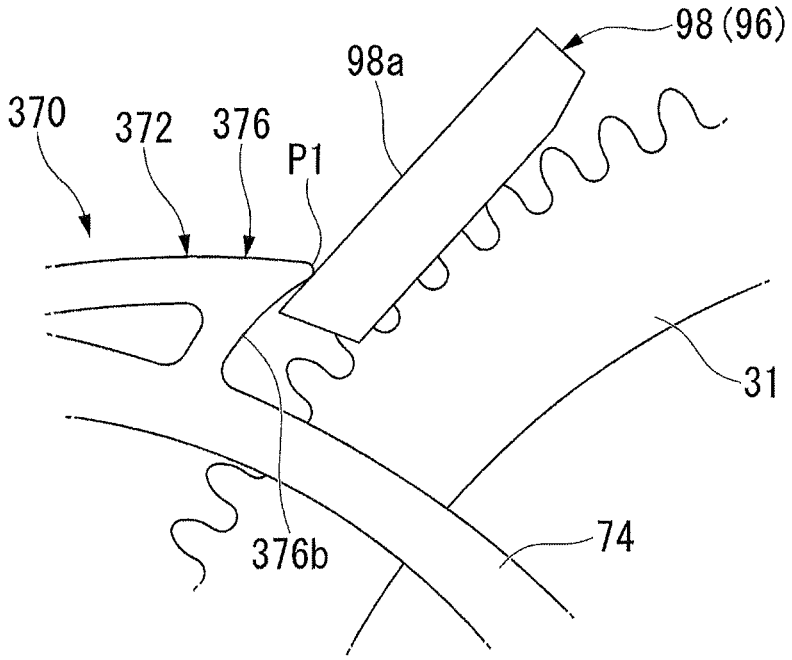
FIG. 17 is a partially enlarged plan view illustrating an engagement state between a stop wheel and a stopper according to a third modification example of the first embodiment of the present invention.

FIG. 17 is a partially enlarged plan view illustrating an engagement state between a stop wheel 372 (stop wheel & pinion 370) and the stopper 96 according to the third modification example of the first embodiment.

As illustrated in the drawing, a different point between the first embodiment and the third modification example of the first embodiment is that an engagement state is different between a hook 376 of the stop wheel 372 and the pawl 98 of the stopper 96.

More specifically, in the first embodiment, the hook 76 and the pawl 98 are engaged with each other, in a state where the distal end of the pawl 98 is in contact with the lateral side 76*b* (refer to FIG. 6) of the hook 76. In contrast, in the third modification example of the first embodiment, the hook 376 and the pawl 98 are engaged with each other, in a state where the apex P1 of the hook 376 is in contact with the lateral side 98*a* of the pawl 98.

As compared to the hook 76 of the first embodiment, the hook 376 is formed so that the apex P1 is more gradually tilted forward in order for the apex P1 to come into contact with the pawl 98 earlier than a lateral side 376*b*.

Here, the pawl 98 is generally formed of ruby. Therefore, as compared to a case where the distal end of the pawl 98 is brought into contact with the lateral side 76*b* (refer to FIG. 6) of the hook 76 as previously described in the first embodiment, the stop wheel 372 is less likely to be damaged, by adopting a configuration where the apex P1 of the hook 376 is brought into contact with the lateral side 98*a* of the pawl 98 as described in the third modification example of the first embodiment.

More specifically, for example, Vickers hardness (HV) of the ruby forming the pawl 98 is approximately 2,000. In contrast, the stop wheel 372 is generally formed of a metal material such as nickel. Vickers hardness of the metal such as nickel is approximately 500 to 700. Here, since a component is vulnerable to the impact of harder material, as compared to a case where a sharp distal end portion formed of the ruby collides with the component, the damage is unlikely to occur in a case where a sharp distal end portion formed of the nickel collides with the component. Therefore, the stop wheel 372 is less likely to be damaged. Accordingly, it is possible to lengthen the durability of the stop wheel 372.

In the above-described third modification example, a case has been described where the apex P1 of the hook 376 is brought into contact with the lateral side 98*a* of the pawl 98 by changing the shape of the hook 376. However, without being limited thereto, a configuration may be adopted where the apex P1 of the hook 376 is brought into contact with the lateral side 98*a* of the pawl 98 by changing an attachment angle of the pawl 98. However, when this configuration is adopted, if a designed angle of the pawl 98 is greatly changed, an orientation of the force (vector) does not pass through the rotation center of the stop wheel 372. In this case, there is a possibility of poor performance of the constant force. Consequently, it is necessary to pay attention to the design.

Fourth Modification Example of First Embodiment

Next, referring to FIG. 18, the fourth modification example of the first embodiment will be described.

Figure 18:
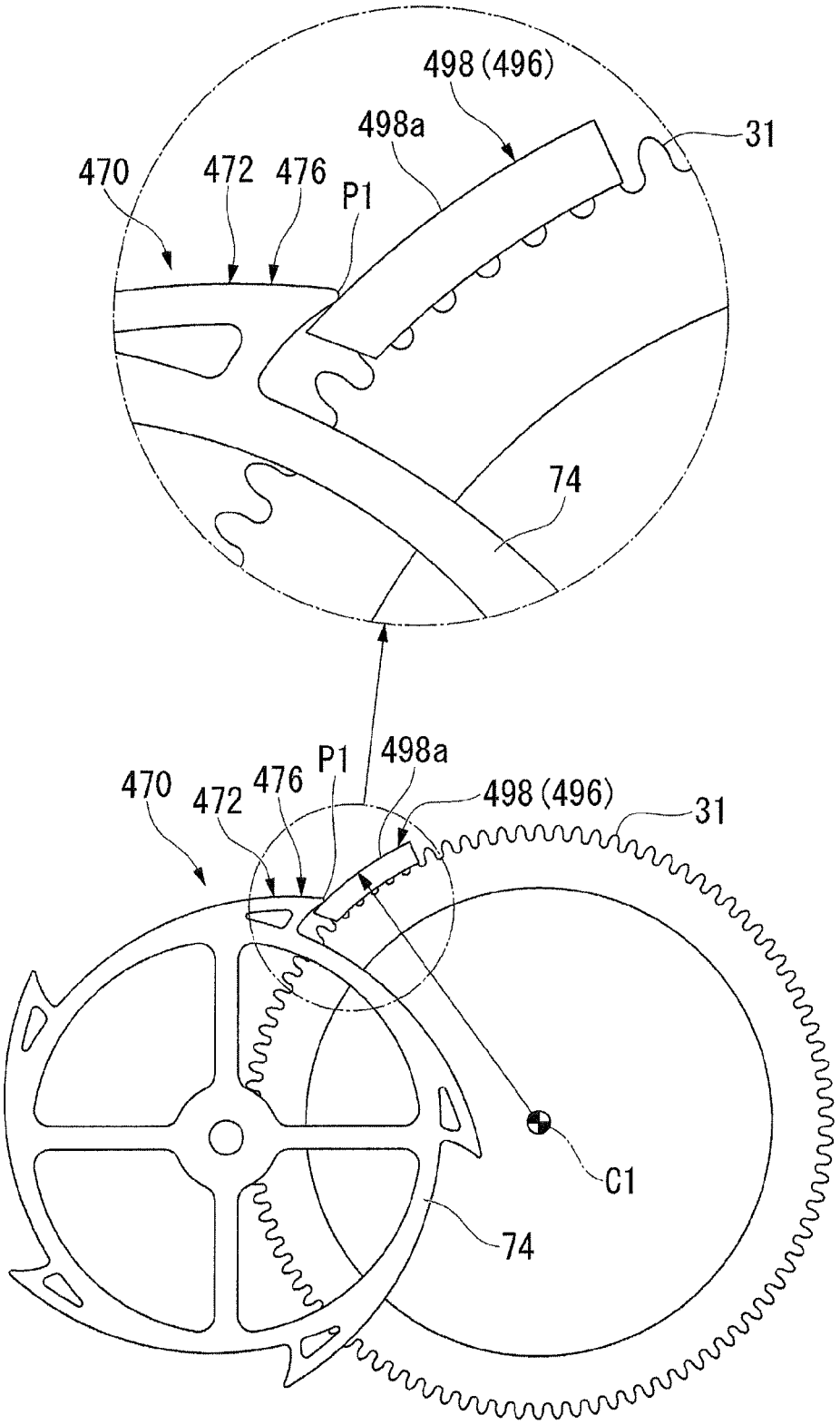
FIG. 18 is a plan view illustrating an engagement state between a stop wheel and a pawl of a stopper according to a fourth modification example of the first embodiment of the present invention.

FIG. 18 is a plan view illustrating an engagement state between a stop wheel 472 (stop wheel & pinion 470) and a pawl 498 of a stopper 496 according to a fourth modification example of the first embodiment.

As illustrated in the drawing, a different point between the third modification example of the first embodiment and the fourth modification example of the first embodiment is that a shape of the pawl 498 is different.

More specifically, a lateral side 498*a* on the outer peripheral side in the pawl 498 is formed in an arc shape. The center of the arc is located coaxially with the axial center C1 of the fixed wheel & pinion 31, that is, the rotation center of the outer carriage 33 and the rotation center of the inner carriage 34. Therefore, the vector of the force which is applied to the stopper 496 by the stop wheel 472 always passes through the rotation center of the outer carriage 33 and the rotation center of the inner carriage 34. Accordingly, it is possible to minimize the influence in which a load applied when the stop wheel & pinion 470 and the stopper 496 are engaged with each other is applied to the outer carriage 33 or the inner carriage 34.

To be more specific about this influence, when the vector of the force applied to the stopper 496 by the stop wheel & pinion 470 does not pass through the rotation center, the outer carriage 33 a applies a torque to the inner carriage 34 so as to be rotated forward or rearward. Therefore, the rotation torque of the inner carriage 34 is obtained by adding or deducting the torque transmitted from the outer carriage 33 to or from the torque generated by the constant force spring 68. The torque of the outer carriage 33 varies in proportion to the torque of the barrel wheel 22. As a result, the rotation torque of the inner carriage 34 is no longer constant.

Incidentally, in the above-described fourth modification example, when the inner carriage 34 is rotated in practice and is moved in a direction where the pawl 498 is disengaged from the hook 476 of the stop wheel 472 (clockwise direction in FIG. 18), a friction force acts between the hook 476 and the pawl 498. This friction force causes the vector of the force applied to the stopper 496 by the stop wheel 472 to be shifted from the axial center C1. Therefore, it is desirable to from the shape of the hook 476 (76 or 376) as follows.

Fifth Modification Example of First Embodiment

Figure 19:
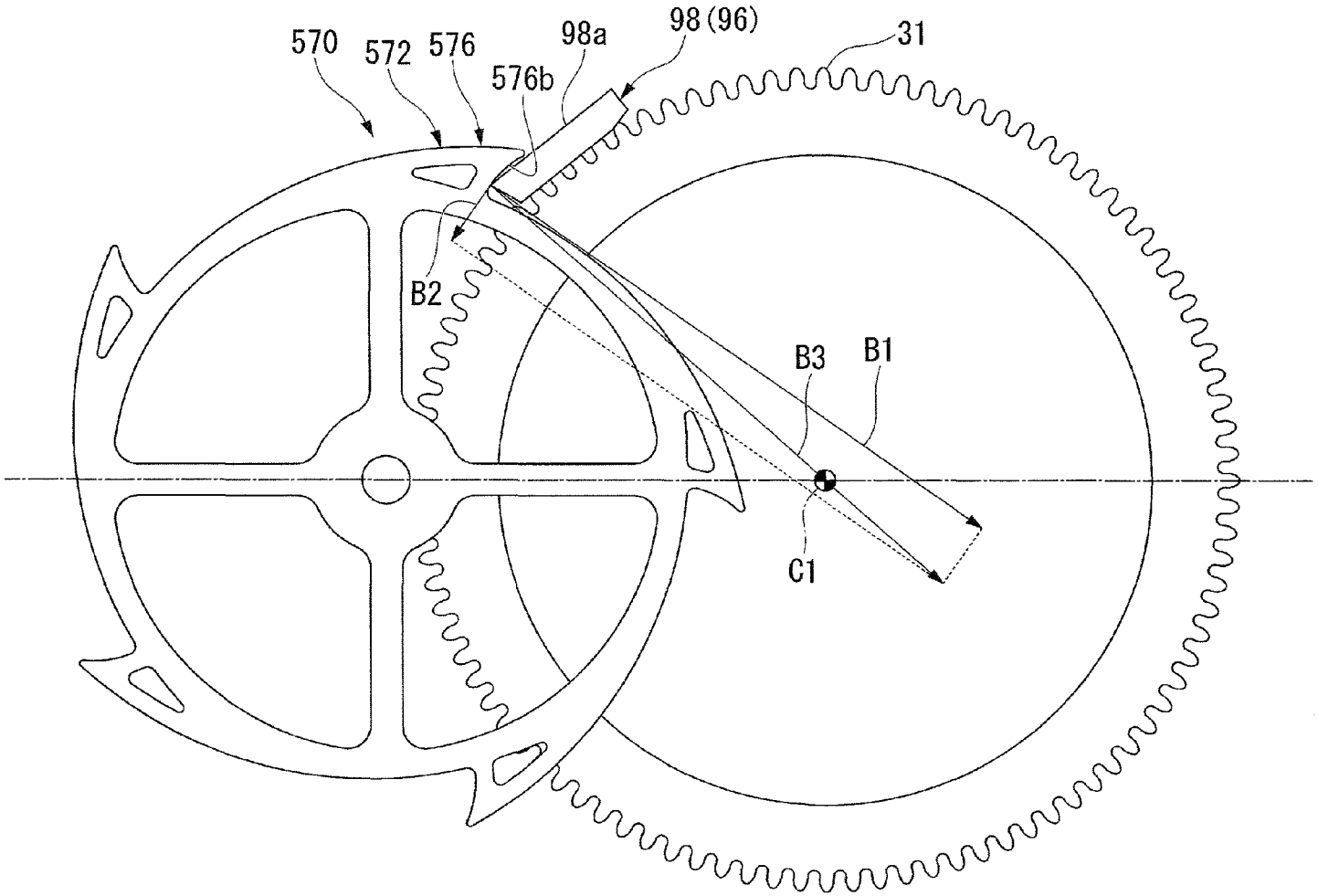
FIG. 19 is a plan view of a stop wheel according to a fifth modification example of the first embodiment of the present invention.

FIG. 19 is a plan view of a stop wheel 572 according to a fifth modification example of the first embodiment, and corresponds to FIG. 6 in the above-described first embodiment.

As illustrated in the drawing, a lateral side 576*b* in a hook 576 of the stop wheel 572 is formed so that a combined force vector B3 including a vector B1 in a normal direction of a portion with which the pawl 98 is in contact and a vector B2 of the friction force applied to the pawl 98 passes through the axial center C1 (rotation center of the outer carriage 33 and the inner carriage 34) of the fixed wheel & pinion 31.

According to this configuration, it is possible to more reliably minimize the influence in which a load applied when the stop wheel 572 and the pawl 98 are engaged with each other is applied to the outer carriage 33 or the inner carriage 34.

Second Embodiment

Next, referring to FIGS. 20 and 21, a second embodiment will be described.

Figure 20:
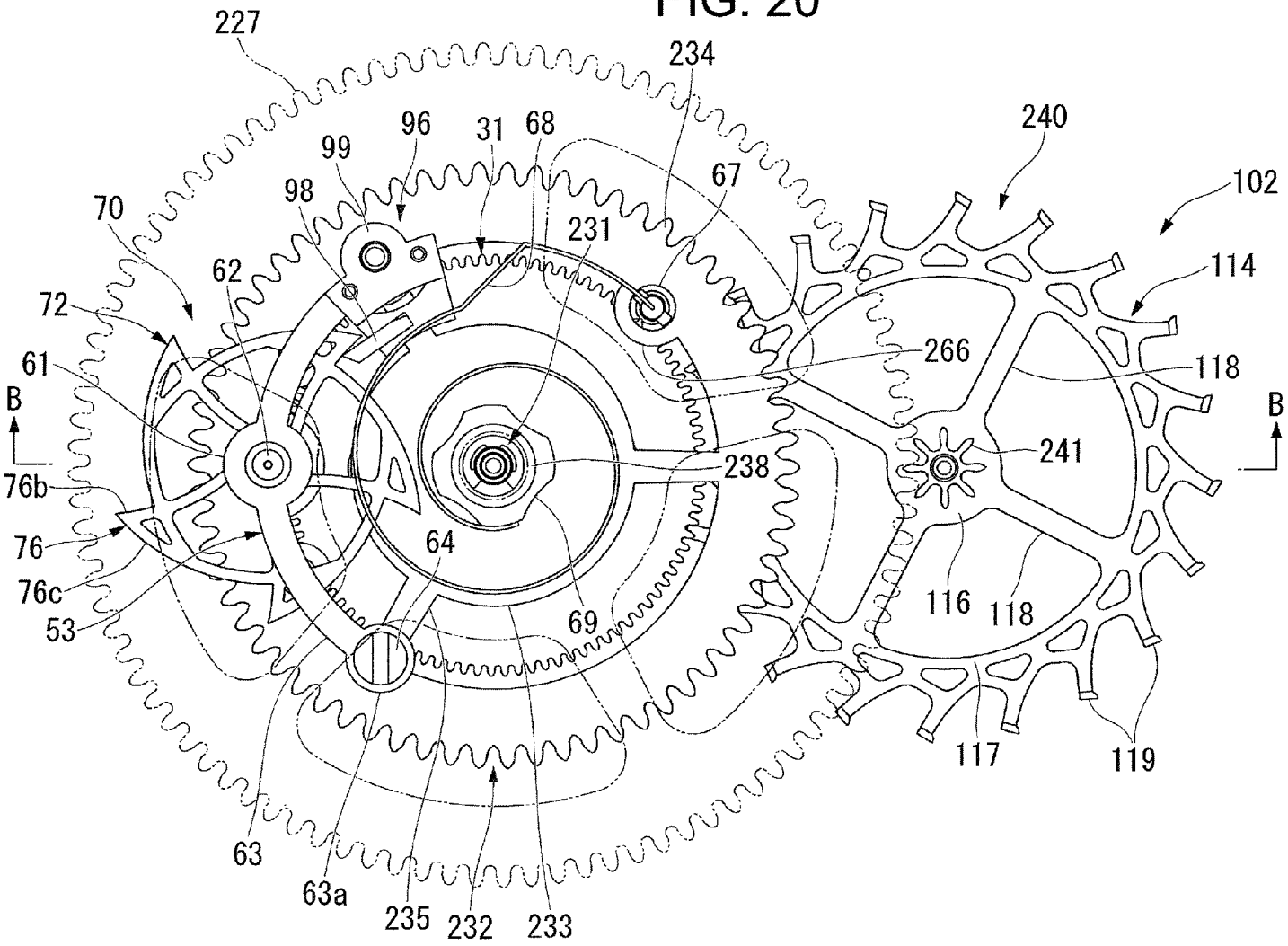
FIG. 20 is a plan view of a constant force device according to a second embodiment of the present invention.

FIG. 20 is a plan view of a constant force device 230 according to the second embodiment, and illustrates a second wheel & pinion 227 by using a two-dot chain line. FIG. 21 is a cross-sectional view taken along line B-B in FIG. 20.

Figure 21:
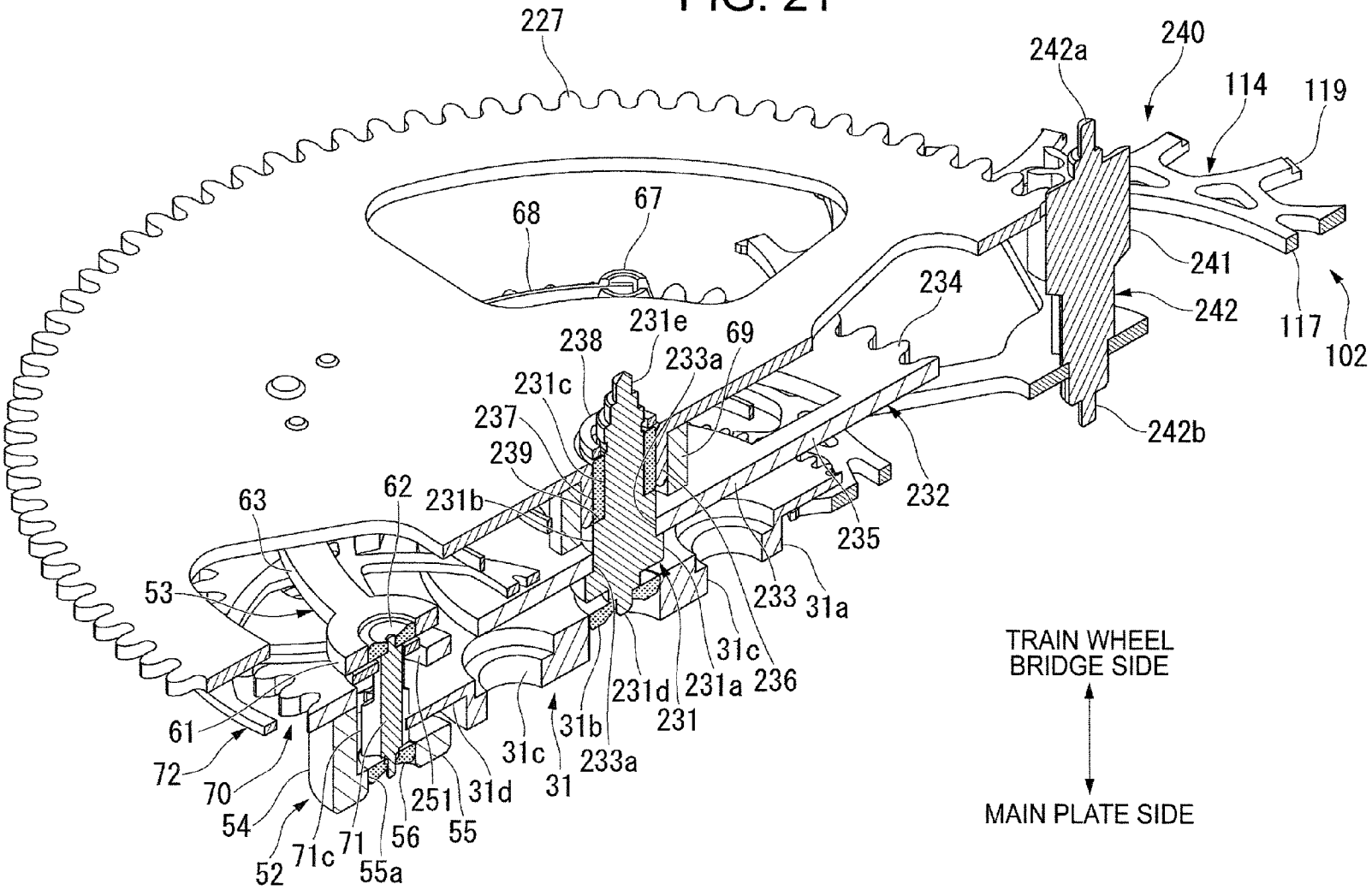
FIG. 21 is a cross-sectional view taken along line B-B in FIG. 17.

As illustrated in FIGS. 20 and 21, a different point between the first embodiment and the second embodiment is that whereas the tourbillion with constant force 30 according to the first embodiment has a so-called a tourbillion function, the constant force device 230 according to the second embodiment does not have the tourbillion function. In addition, in the constant force device 230, the second wheel & pinion 227 also functions as a partial configuration (output unit). The second embodiment is not provided with the fifth wheel & pinion 28 unlike the first embodiment.

More specifically, the constant force device 230 includes the fixed wheel & pinion 31 which is fixed to the main plate 11 (not illustrated in FIGS. 20 and 21), an axle body 231 which is rotatably supported by the hole jewel 31*b* of the fixed wheel & pinion 31 and a hole jewel disposed in a train wheel bridge (not illustrated), a carriage 232 and a second wheel & pinion 227 which are attached to the axle body 231, the stop wheel & pinion 70 which is attached to the axle body 232, and the escapement mechanism 102 which meshes with the second wheel & pinion 227.

As illustrated in FIG. 21, the axle body 231 is configured so that the fixed wheel & pinion 31 side slightly separated from the substantial center in the axial direction serves as a large diameter portion 231*a* whose axle diameter is the largest. Then, the axle body 231 is formed so that the diameter is gradually decreased by a step difference as it goes from the large diameter portion 231*a* toward both ends in the axial direction.

More specifically, in the axle body 231, a first axle 231*b* whose diameter is more decreased than the large diameter portion 231*a* is integrally molded on the train wheel bridge side (upper side in FIG. 21) of the large diameter portion 231*a*. Furthermore, a second axle 231*c* whose diameter is more decreased than the first axle 231*b* is integrally molded in the distal end of the first axle 231*b*. Then, tenons 231*d* and 231*e* are respectively formed to protrude axially outward, in the distal end of the second axle 231*c* and the fixed wheel & pinion 31 side of the large diameter portion 231*a*.

In the axle body 231 configured as described above, one tenon 231*d* is inserted into the hole jewel 31*b* of the fixed wheel & pinion 31, and the other tenon 231*e* is inserted into the hole jewel of the train wheel bridge (not illustrated). In this manner, the axle body 231 is rotatably supported.

In addition, the carriage 232 is externally fitted and fixed to the first axle 231*b* of the axle body 231, and the second wheel & pinion 227 is rotatably supported by the second axle 231*c* of the axle body 231. That is, whereas the carriage 232 is rotated integrally with the axle body 231, the second wheel & pinion 227 is supported so as to be relatively rotatable with the carriage 232.

The carriage 232 has a substantially annular hub 233 which is press-fitted to or inserted into the axle body 231. The axle body 231 is press-fitted to or inserted into a through-hole 233*a* formed in the hub 233. When the axle body 231 is inserted into the through-hole 233*a*, the carriage 232 is bonded and fixed to the axle body 231 by an adhesive.

In addition, an external gear 234 which is formed in a ring shape so as to surround the hub 233 is disposed outside in the radial direction of the hub 233. The external gear 234 meshes with the third wheel & pinion (not illustrated).

In addition, the hub 233 and the external gear 234 are connected to each other by three spokes 235. The three spokes 235 extend along the radial direction, and are arranged at equal intervals in the circumferential direction.

Furthermore, in the external gear 234, a stop wheel bearing unit 250 for rotatably supporting the stop wheel & pinion 70 is disposed between two spokes 235, among the three spokes 235.

The stop wheel bearing unit 250 is configured to have an axle body insertion hole 251 which is formed in the external gear 234, the first stop wheel bearing 52 which is attached to the main plate 11 side (lower side in FIG. 21) of the external gear 234, and the second stop wheel bearing 53 which is attached to the train wheel bridge side (upper side in FIG. 21) of the external gear 234.

The axle body insertion hole 251 is formed so that the stop wheel axle body 71 configuring the stop wheel & pinion 70 can be inserted into the axle body insertion hole 251.

The configuration of the first stop wheel bearing 52, the second stop wheel bearing 53 and the stop wheel & pinion 70 is the same as that in the above-described first embodiment. Accordingly, the same reference numerals are given thereto, and description thereof will be omitted. That is, the configuration where in the hook 76 of the stop wheel & pinion 70, the lateral side 76*b* on the front side is formed in an arc shape and the center of the arc is set to be coaxial with the axle body 231 is also the same as that in the above-described first embodiment. In addition, the configuration where the stop pinion 71*c* configuring the stop wheel & pinion 70 meshes with the tooth portion 31*d* of the fixed wheel & pinion 31 is also the same as that in the above-described first embodiment.

Furthermore, on an inner periphery side of the external gear 234, a stud support 266 is integrally formed on a side which is substantially opposite to a portion having the stop wheel bearing unit 250 across the axle body 231. The stud 67 is press-fitted to the stud support 266. An outer end portion of the constant force spring 68 is fixed to the stud 67. In contrast, an inner end portion of the constant force spring 68 is fixed to the second wheel & pinion 227 via the collet 69.

A cylindrical bearing housing 236 protruding toward the carriage 232 side is integrally molded in the substantial center in the radial direction of the second wheel & pinion 227. The collet 69 is externally fitted and fixed to the bearing housing 236.

In addition, a cylindrical bearing 237 is press-fitted to the bearing housing 236. The second wheel & pinion 227 is rotatably supported by the second axle 231*c* of the axle body 231 via the bearing 237. The bearing 237 if formed of ruby, for example.

Furthermore, a C-shaped retaining ring 238 is attached to the distal end side (the other tenon 231*e* side) of the second axle 231*c*. The axial movement of the second wheel & pinion 227 is regulated by the C-shaped retaining ring 238 and a stepped portion 239 formed between the second axle 231*c* and the first axle 231*b*.

In addition, the stopper 96 which is engaged with or disengaged from the hook 76 of the stop wheel & pinion 70 is disposed in the second wheel & pinion 227. The configuration of the stopper 96 is also the same as that in the above-described first embodiment. Accordingly, the same reference numerals are given thereto, and description thereof will be omitted.

An escape pinion 241 of an escape wheel & pinion 240 meshes with the second wheel & pinion 227 configured as described above. The escape wheel & pinion 240 includes an axle body 242, and an escape wheel 114 which is externally fitted and fixed to the axle body 242.

A first tenon 242*a* and a second tenon 242*b* whose diameters are respectively decreased by a step difference are integrally molded in both ends of the axle body 242. The first tenon 242*a* is rotatably supported by the train wheel bridge (not illustrated). In contrast, the second tenon 242*b* is rotatably supported by the main plate 11. In addition, the escape pinion 241 is integrally molded in a portion from the substantial center of the axle body 242 in the axial direction through the first tenon 242*a*.

The escape wheel 6*c* pinion 240 configured as described above configures the escapement mechanism. The escapement mechanism of the second embodiment also has a basic configuration which is the same as that of the escapement mechanism 102 in the above-described first embodiment. Accordingly, description thereof will be omitted. In addition, similar to the first embodiment, the second embodiment is also provided with the balance with hairspring. However, the balance with hairspring is also configured as described in the first embodiment. Accordingly, in the second embodiment, illustration and description of the balance with hairspring will be omitted.

(Operation of Constant Force Device)

Next, an operation of a constant force device 230 will be described.

First, a rotation force received by the carriage 232 and an operation of the stop wheel & pinion 70 receiving the rotation force will be described.

Since the external gear 234 meshes with the third wheel & pinion (not illustrated), the rotation force of the barrel wheel (not illustrated) is transmitted to the carriage 232 via the front train wheel. In addition, in the stop wheel & pinion 70, the stop pinion 71*c* meshes with the tooth portion 31*d* of the fixed wheel & pinion 31. Therefore, if the carriage 232 is rotated, the stop wheel & pinion 70 rotates about the axial center of the stop pinion 71*c*, and revolves around the fixed wheel & pinion 31.

In contrast, the second wheel & pinion 227 is supported to be rotatable with respect to the carriage 232, and is connected to the carriage 232 via the constant force spring 68. Therefore, the second wheel & pinion 227 is rotated with respect to the carriage 232 by receiving a biasing force of the constant force spring 68.

In addition, the escape pinion 241 of the escape wheel & pinion 240 meshes with the second wheel & pinion 227. The second wheel & pinion 227 always rotates at a constant speed. Accordingly, the second wheel & pinion 227 is controlled so as to be rotated once per minute.

Here, the hook 76 of the stop wheel & pinion 70 and the pawl 98 of the stopper 96 are repeatedly engaged with or disengaged from each other. When the hook 76 of the stop wheel & pinion 70 and the pawl 98 of the stopper 96 are engaged with each other and the rotation of the stop wheel & pinion 70 is stopped, the rotation of the carriage 232 is also stopped. In contrast, the second wheel & pinion 227 is continuously rotated by the biasing force of the constant force spring 68.

Then, if the stopper 96 is moved in response to the rotation of the second wheel & pinion 227 and the pawl 98 of the stopper 96 and the hook 76 of the stop wheel & pinion 70 are disengaged from each other, the carriage 232 is rotated. At this time, the stop wheel & pinion 70 rotates about the axial center of the stop pinion 71*c*, and revolves around the fixed wheel & pinion 31. In other words, the stop wheel & pinion 70 rotates while moving toward the stopper 96. Then, the hook 76 of the stop wheel & pinion 70 and the pawl 98 of the stopper 96 are engaged with each other again, and the rotation of the stop wheel & pinion 70 is stopped.

Similar to the above-described first embodiment, the maximum meshing amount between the hook 76 of the stop wheel & pinion 70 and the pawl 98 of the stopper 96 represents an amount in a range corresponding to the extent of six degrees rotated about the axle body 231, within the hook 76. In addition, the angle in which the carriage 232 is rotated until the hook 76 and the pawl 98 are disengaged from each other, the stop wheel & pinion 70 is rotated, and the stop wheel & pinion 70 is stopped again represents six degrees, similar to the above-described first embodiment.

Here, since the carriage 232 is rotated, the stud 67 fixed to the carriage 232 is also moved integrally with the carriage 232. Since the stud 67 is moved, the constant force spring 68 is wound up. Specifically, the constant force spring 68 is wound up to an extent where the carriage 232 is rotated six times.

Then, in a state where the constant force spring 68 is wound up, the carriage 232 (stop wheel & pinion 70) is stopped and the biasing force of the constant force spring 68 causes the second wheel & pinion 227 to be rotated. Since this operation is repeated, the second wheel & pinion 227 is continuously rotated at a constant speed.

Therefore, according to the above-described second embodiment, it is possible to stop or resume the rotation of the stop wheel & pinion 70 by rotating the stopper 96 integrally with the second wheel & pinion 227 and further rotating the stop wheel & pinion 70 integrally with the carriage 232. Accordingly, it is not necessary to use an oscillating member as in the related art in order to control the rotation of the stop wheel & pinion 70. To that extent, it is possible to decrease the power loss. In other words, since the stop wheel & pinion 70 and the second wheel & pinion 227 are in close contact with each other, it is possible to decrease the loss received by the second wheel & pinion 227 from the stop wheel & pinion 70.

In addition, in order to cause the stop wheel & pinion 70 to rotate and to revolve around the fixed wheel & pinion 31, a configuration is adopted where the stop pinion 71*c* is disposed in the stop wheel & pinion 70 and the stop pinion 71*c* is caused to mesh with the tooth portion 31*d* of the fixed wheel & pinion 31. Therefore, it is possible to cause the stop wheel & pinion 70 and the stopper 96 to be engaged with or disengaged from each other by using a simple structure. Accordingly, it is possible to reduce the weight, the size, and the costs of the constant force device 230.

Furthermore, the second wheel & pinion 227 also serves as a partial configuration of the constant force device 230. Accordingly, it is possible to save the arrangement space of the constant force device 230, and it is possible to reduce the number of components in the constant force device 230.

Modification Example of Second Embodiment

Next, referring to FIG. 22, a modification example of the second embodiment will be described.

Figure 22:
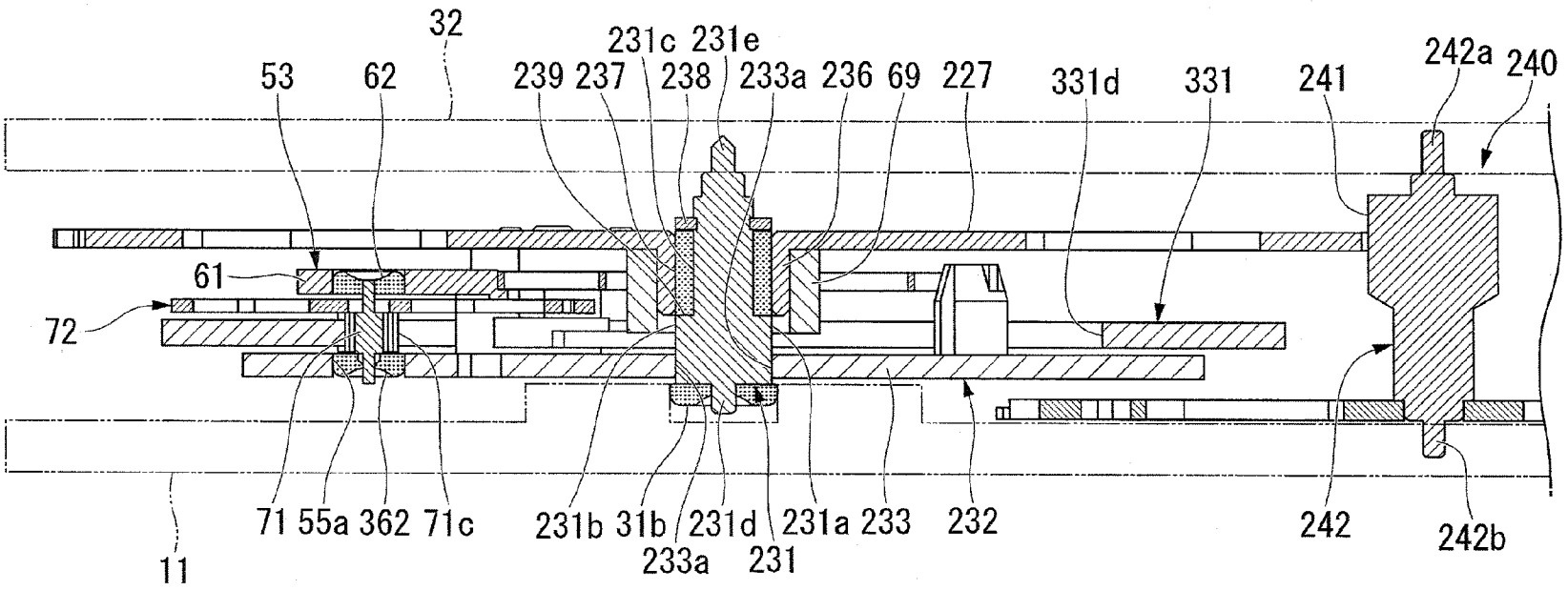
FIG. 22 is a cross-sectional view of a constant force device according to a modification example of the second embodiment of the present invention.

FIG. 22 is a cross-sectional view of a constant force device 330 according to the modification example of the second embodiment.

As illustrated in the drawing, a different point between the constant force device 230 of the second embodiment and the constant force device 330 according to the modification example of the second embodiment is that a shape of the fixed wheel & pinion 31 of the second embodiment is different from a shape of a fixed wheel & pinion 331 according to the modification example of the second embodiment.

More specifically, the fixed wheel & pinion 331 according to the modification example of the second embodiment is formed in a ring shape, and a tooth portion 331*d* is formed in an inner peripheral edge thereof. Then, a pitch circle diameter of the tooth portion 331*d* of the fixed wheel & pinion 331 is set to have a size which enables the tooth portion 331*d* to mesh with the stop pinion 71*c* of the stop wheel axle body 71.

In addition, the stop wheel & pinion 70 does not have the first stop wheel bearing 52. The respective tenons 71*a* and 71*b* of the stop wheel axle body 71 are rotatably supported by the hole jewel 62 of the second stop wheel bearing 53 and a hole jewel 362 disposed in the carriage 232.

According to this configuration, the fixed wheel & pinion 331 is not disposed in the main plate 11 unlike the above-described second embodiment, and is arranged between the second stop wheel bearing 53 and the carriage 232.

Therefore, according to the modification example of the above-described second embodiment, it is not necessary to ensure a space for arranging the fixed wheel & pinion 331 between the carriage 232 and the main plate 11. Accordingly, to that extent, it is possible to decrease the thickness of the constant force device 330.

The present invention is not limited to the above-described embodiments. Within a range not departing from the spirit of the present invention, various modifications can be added to the above-described embodiments.

For example, in the above-described embodiments, a case has been described where the lateral side 76*b* on the front side of the hook 76 of the stop wheel & pinion 70 is formed in an arc shape, the center of the arc is set to be coaxial with the rotation center of the outer carriage 33 in the first embodiment, and the center of the arc is set to be coaxial with the axle body 231 in the second embodiment. However, without being limited thereto, the lateral side 76*b* may be formed in any shape which enables the hook 76 to be engaged with or disengaged from the pawl 98 of the stopper 96.

In addition, in the above-described first embodiment, a case has been described where the inner end portion of the constant force spring 68 is fixed to the axle 83*b* of the inner carriage 34 via the collet 69. Furthermore, in the above-described second embodiment, a case has been described where the inner end portion of the constant force spring 68 is externally fitted and fixed to the bearing housing 236 of the second wheel & pinion 227 via the collet 69. However, without being limited thereto, a configuration may be adopted where the collets 69 are respectively lightly press-fitted to the axle 83*b* of the inner carriage 34 and the bearing housing 236 of the second wheel & pinion 227.

According to this configuration, it is possible to adjust a predetermined winding amount (initial winding amount) of the constant force spring 68 by rotating the collet 69 around the axial center with respect to the axle 83*b* of the inner carriage 34 and the bearing housing 236 of the second wheel & pinion 227. In this manner, it is possible to adjust the output torque of the constant force spring 68. Therefore, it is possible to adjust an oscillation angle of the balance with hairspring (for example, the balance with hairspring 101 in FIGS. 2 and 3).

In addition, in the above-described first embodiment, a case has been described where the outer end portion of the constant force spring 68 is fixed to the outer carriage 33 and the inner end portion of the constant force spring 68 is fixed to the inner carriage 34. Furthermore, in the above-described second embodiment, a case has been described where the outer end portion of the constant force spring 68 is fixed to the external gear 234 and the inner end portion of the constant force spring 68 is fixed to the second wheel & pinion 227. However, without being limited thereto, inner end portions of the constant force spring 68 may be respectively fixed to the outer carriage 33 and the external gear 234, and outer end portions of the constant force spring 68 may be respectively fixed to the inner carriage 34 and the second wheel & pinion 227.

Here, in the constant force spring 68, as compared to the outer end portion, the inner end portion is less likely to receive the influence of a step movement (in the above-described first embodiment and second embodiment, a movement in which the outer carriage 33 and the second wheel & pinion 227 are rotated at a six degree pitch) of the input side (the outer carriage 33 and the second wheel & pinion 227). Therefore, according to the above-described configuration, it is possible to cause the constant force spring 68 to be stably operated.

In addition, in the above-described second embodiment, a case has been described where the second wheel & pinion 227 also serves as a partial configuration of the constant force device 230. However, without being limited thereto, any one of the escape wheel 114, the second wheel & pinion 227, the third wheel & pinion 26, and the center wheel & pinion 25 can be configured as the partial configuration (output unit) of the constant force device 230.

Furthermore, in the modification example of the above-described second embodiment, a case has been described which employs the fixed wheel & pinion 331 formed in a ring shape. However, without being limited thereto, the above-described first embodiment and the respective modification examples of the first embodiment can also employ the fixed wheel & pinion 331 formed in the ring shape. In this manner, it is possible to decrease the thickness of the tourbillion with constant force device 30.

What is claimed is:

1. A constant force device for adjusting an output torque, comprising:

an output unit that outputs the output torque by being rotated around an output axle;

a constant force spring that supplies a rotation force to the output unit;

an input unit that stores a resilient force in the constant force spring by being rotated around an input axle;

a stop wheel & pinion that is supported to be rotatable around a stop wheel axle body in the input unit, and that is rotatable around the input axle; and a stopper that is rotated around the output axle together with the output unit, and that engages with the stop wheel & pinion in response to rotation of the stop wheel & pinion which is rotated around the stop wheel axle body.

2. The constant force device according to claim 1, wherein the input axle and the output axle are arranged coaxially with each other.

3. The constant force device according to claim 1, further comprising:

a fixed wheel & pinion that is disposed coaxially with the input axle, and that is not rotatable together with the input unit and the output unit, wherein the stop wheel & pinion has a stop wheel axle body in which the stop wheel axle serves as a axial center, and wherein the stop wheel axle body is configured to be rotatable around the input axle by being arranged so as to engage with the fixed wheel & pinion.

4. The constant force device according to claim 2, further comprising:

a fixed wheel & pinion that is disposed coaxially with the input axle, and that is not rotatable together with the input unit and the output unit, wherein the stop wheel & pinion has a stop wheel axle body in which the stop wheel axle serves as a axial center, and wherein the stop wheel axle body is configured to be rotatable around the input axle by being arranged so as to engage with the fixed wheel & pinion.

5. The constant force device according to claim 1, wherein the stop wheel & pinion has a tooth surface formed in a substantially arc shape in which the input axle serves as a center.

6. The constant force device according to claim 2, wherein the stop wheel & pinion has a tooth surface formed in a substantially arc shape in which the input axle serves as a center.

7. The constant force device according to claim 3, wherein the stop wheel & pinion has a tooth surface formed in a substantially arc shape in which the input axle serves as a center.

8. The constant force device according to claim 4, wherein the stop wheel & pinion has a tooth surface formed in a substantially arc shape in which the input axle serves as a center.

9. The constant force device according to claim 1, wherein the output unit supports a balance with hairspring so as to be rotatable.

10. The constant force device according to claim 2, wherein the output unit supports a balance with hairspring so as to be rotatable.

11. The constant force device according to claim 3, wherein the output unit supports a balance with hairspring so as to be rotatable.

12. The constant force device according to claim 4, wherein the output unit supports a balance with hairspring so as to be rotatable.

13. The constant force device according to claim 5, wherein the output unit supports a balance with hairspring so as to be rotatable.

14. The constant force device according to claim 6, wherein the output unit supports a balance with hairspring so as to be rotatable.

15. The constant force device according to claim 1, wherein the output unit is configured to any one from among an escape wheel & pinion, a second wheel & pinion, a third wheel & pinion, and a center wheel & pinion.

16. The constant force device according to claim 1, further comprising:

a phase shift regulation mechanism that regulates a rotation movement of the output unit with respect to the input unit, wherein the phase shift regulation mechanism regulates the rotation movement in a direction in which a phase of the input unit is delayed with respect to the output unit.

17. The constant force device according to claim 16, wherein the phase shift regulation mechanism regulates the rotation movement in a direction in which a phase of the input unit is quickened with respect to the output unit.

18. The constant force device according to claim 16, wherein the phase shift regulation mechanism has:

a projection which is formed in any one of the output unit and the input unit; and a hole which is formed in the other one of the output unit and the input unit, and which can engage with the projection.

19. A movement comprising:

the constant force according to claim 1; and a balance with hairspring that is operated by an output torque supplied from the constant device.

20. A mechanical timepiece comprising:

the movement according to claim 19.

* * * * *